US010373441B1

(12) United States Patent
Halvorson

(10) Patent No.: US 10,373,441 B1
(45) Date of Patent: Aug. 6, 2019

(54) GAMING SYSTEM AND METHOD INCLUDING PLACEHOLDER SYMBOLS AND REPLACEMENT SYMBOLS

(71) Applicant: ADP GAUSELMANN GMBH, Espelkamp (DE)

(72) Inventor: Michael Charles Halvorson, Las Vegas, NV (US)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

(21) Appl. No.: 16/020,252

(22) Filed: Jun. 27, 2018

(51) Int. Cl.
*G07F 17/32* (2006.01)
*G07F 17/34* (2006.01)

(52) U.S. Cl.
CPC ..... *G07F 17/3267* (2013.01); *G07F 17/32* (2013.01); *G07F 17/326* (2013.01); *G07F 17/3213* (2013.01); *G07F 17/3244* (2013.01); *G07F 17/34* (2013.01)

(58) Field of Classification Search
None
See application file for complete search history.

(56) References Cited

U.S. PATENT DOCUMENTS 7,794,320 B2 9/2010 Baerlocher et al.
2003/0199312 A1* 10/2003 Walker ..... G07F 17/32 463/25
2004/0048651 A1* 3/2004 Vorias ..... G07F 17/3262 463/20
2006/0084494 A1* 4/2006 Belger ..... G07F 17/3265 463/20
2010/0120489 A1 5/2010 Meyer
2011/0117989 A1 5/2011 Kennedy et al.
2011/0136565 A1 6/2011 Low
2014/0018146 A1 1/2014 Zielinski et al.
2014/0087860 A1 3/2014 Basalllo et al.
2014/0087861 A1 3/2014 Basallo et al.
2014/0228091 A1* 8/2014 Berman ..... G07F 17/34 463/20
2014/0329591 A1* 11/2014 Caputo ..... G07F 17/3267 463/29
2015/0080096 A1 3/2015 Saunders et al.
2015/0141114 A1 5/2015 Davis et al.
2015/0363998 A1* 12/2015 Comeau ..... G07F 17/3265 463/20
2016/0210821 A1* 7/2016 Marks ..... G07F 17/34
2017/0032610 A1 2/2017 Loz et al.
2018/0218572 A1 8/2018 Caputo
2018/0261045 A1 9/2018 Takahara et al.

* cited by examiner

*Primary Examiner* — Jason T Yen
(74) *Attorney, Agent, or Firm* — Resolute Legal PLLC

(57) ABSTRACT

Various embodiments of a gaming system and method are disclosed as having placeholder symbols and replacement symbols. In some embodiments, the gaming system generates a plurality of replacement symbols. If the gaming system also randomly generates a placeholder symbol, the gaming system randomly determines which one of the generated plurality of replacement symbols to associate with the generated placeholder symbol. The gaming system may replace the generated placeholder symbol with the associated replacement symbol. In some embodiments the plurality of replacement symbols are generated and displayed above the generated placeholder symbol such that the associated replacement symbol is pulled down to be applied in place of the generated placeholder symbol.

20 Claims, 18 Drawing Sheets

GAMING SYSTEM AND METHOD INCLUDING PLACEHOLDER SYMBOLS AND REPLACEMENT SYMBOLS

FIELD OF THE INVENTION

The present disclosure relates to gaming devices.

SUMMARY OF THE INVENTION

Various embodiments of a gaming system and method are disclosed as having placeholder symbols and replacement symbols. In some embodiments, the gaming system generates a plurality of replacement symbols. If the gaming system also randomly generates a placeholder symbol, the gaming system randomly determines which one of the generated plurality of replacement symbols to associate with (or apply to) the generated placeholder symbol. In some embodiments the plurality of replacement symbols are generated and displayed above the generated placeholder symbol such that the associated replacement symbol is pulled down to be applied in place of the generated placeholder symbol.

In some embodiments, the replacement symbols are referred to as pull down symbols. However, it should be appreciated that the term pull down symbol is not limited to a replacement symbol being displayed above a generated place holder symbol and pulled down to be applied in place of the generated placeholder symbol; the pull down symbol can replace an associated replacement symbol in any suitable manner. As used throughout this disclosure, the terms pull down symbol and replacement symbol are interchangeable.

In some embodiments of the gaming system and method having pull down symbols, at least one of the pull down symbols is randomly generated while other pull down symbols are predetermined. In some embodiments, all of the pull down symbols are randomly generated. In some embodiments, the plurality of pull down symbols are each associated with a weight or probability for purposes of random generation from a set of symbols. In some embodiments, some of the pull down symbols are weighted differently from other pull down symbols. In some embodiments, all of the pull down symbols are weighted differently. In some embodiments, some or all of the pull down symbols are weighted equally. In some embodiments, the reels and the generated pull down symbols are initially displayed on different display devices. During a play of a game, a generated pull down symbol can also be displayed on the same display device as the reels. In some embodiments, the reels and the pull down symbols are initially displayed on the same display device. In some embodiments, a symbol set for one or more reels includes one or more placeholder symbols as a possible symbol in a base game. In some embodiments, a symbol set for one or more reels includes one or more placeholder symbols as a possible symbol in a bonus game. In a base or a bonus game, a gaming system may replace one or more generated and displayed placeholder symbols with pull down symbols.

In one embodiment of the gaming system and method having pull down symbols, a gaming system includes a plurality of symbol display areas associated with a plurality of video based slot machine reels. For example, the gaming system may include five video based slot machine reels that are each associated with three symbol display areas. The gaming system further includes a symbol set associated with each slot machine reel, wherein each symbol set includes a plurality of symbols. For a play of a game, for each slot machine reel, the gaming system generates a plurality of symbols from the associated symbol sets for the symbol display areas of the reel. The gaming system evaluates the generated plurality of symbols for winning symbol combinations. The gaming system determines a payout amount based on winning symbol combinations along wagered pay lines. The gaming system also evaluates the generated plurality of symbols for triggering symbol combinations along a wagered pay line. If the gaming system determines that a triggering symbol combination was generated along a wagered pay line, the gaming system activates a bonus game.

In one embodiment, a gaming system randomly generates a plurality of symbols in a bonus game that may include at least one placeholder symbol. The symbols can be displayed in the symbol display areas of the reels on a first display device. The gaming system further randomly generates at least one pull down symbol. The gaming system may include at least one predetermined pull down symbol. The at least one randomly generated pull down symbol and at least one predetermined pull down symbol are displayed on a second display device in one embodiment. Upon determining that the gaming system generated at least one placeholder symbol, the gaming system randomly determines one of the pull down symbols displayed in the second display device for each generated placeholder symbol, for association with such placeholder symbol. In determining the pull down symbol for association with a placeholder symbol, different weights (or probabilities of being selected) may be assigned to each pull down symbol for the determination process. The gaming system displays the determined pull down symbol in the symbol display area of the associated placeholder symbol. The gaming system displays any determined award on the first display device or other suitable display device.

In another embodiment, a gaming system randomly generates a plurality of symbols in a bonus game that may include at least one placeholder symbol. The symbols are disclosed in symbol display areas of reels on a first display device. The gaming system further randomly generates at least one pull down symbol. The at least one randomly generated pull down symbol can be displayed on a second display device. Upon determining that the reels include at least one placeholder symbol, the gaming system randomly determines for at least one generated placeholder symbol, the displayed at least one pull down symbol for association with the at least one placeholder symbol. In an embodiment with a plurality of generated and displayed pull down symbols, the gaming system may randomly determine at least one of the plurality of generated and displayed pull down symbols for association with one or more generated placeholder symbols. When determining the pull down symbols for association with generated and displayed placeholder symbols, the gaming system may assign an equal weight to each pull down symbol for the selection process. The gaming system displays each pull down symbol associated with a displayed placeholder symbol in the symbol display area associated with the displayed placeholder symbol. The gaming system determines any awards based on the randomly generated plurality of symbols and the pull down symbols. It should be appreciated, that in some embodiments, the gaming system may also determine any awards based on the randomly generated plurality of symbols and the placeholder symbols, prior to replacing the placeholder symbols with the pull down symbols.

In another embodiment, a gaming system randomly generates a plurality of symbols in a bonus game that may include at least one placeholder symbol. The symbols are disclosed in symbol display areas of reels on a display device. The gaming system further randomly generates at least one pull down symbol. The gaming system may include at least one predetermined pull down symbol. The at least one randomly generated pull down symbol and the at least one predetermined pull down symbol are displayed on the display device. Upon determining that the reels include at least one placeholder symbol, one of the pull down symbols is determined for each placeholder symbol for association with the placeholder symbol. In determining the pull down symbol, the gaming system may assign different weights to one or more pull down symbols for the determination process. The gaming system displays each pull down symbol associated with a displayed placeholder symbol in the symbol display area associated with the displayed placeholder symbol. The gaming system determines any awards based on the randomly generated plurality of symbols and the pull down symbols. It should be appreciated, that in some embodiments, the gaming system may also determine any awards based on the randomly generated plurality of symbols and the placeholder symbols, prior to replacing the placeholder symbols with the pull down symbols.

DETAILED DESCRIPTION OF THE INVENTION

Various embodiments of a gaming system and method are disclosed as having placeholder symbols and replacement symbols. In some embodiments, the gaming system generates a plurality of replacement symbols. If the gaming system also randomly generates a placeholder symbol, the gaming system randomly determines which one of the generated plurality of replacement symbols to associate with (or apply to) the generated placeholder symbol. The gaming system may replace the generated placeholder symbol with the associated replacement symbol. In some embodiments, the plurality of replacement symbols are generated and displayed above the generated placeholder symbol such that the associated replacement symbol is pulled down to be applied in place of the generated placeholder symbol.

Gaming Device Platform

The features and advantages of the gaming system and method described herein may be provided to a player via a gaming device platform that includes various structures and components for allowing player interaction with the gaming device. While only one gaming device platform will be described in detail herein, the features, objects, and advantages of the gaming system described herein may be implemented in one or more alternative gaming device platforms.

Figure 1:
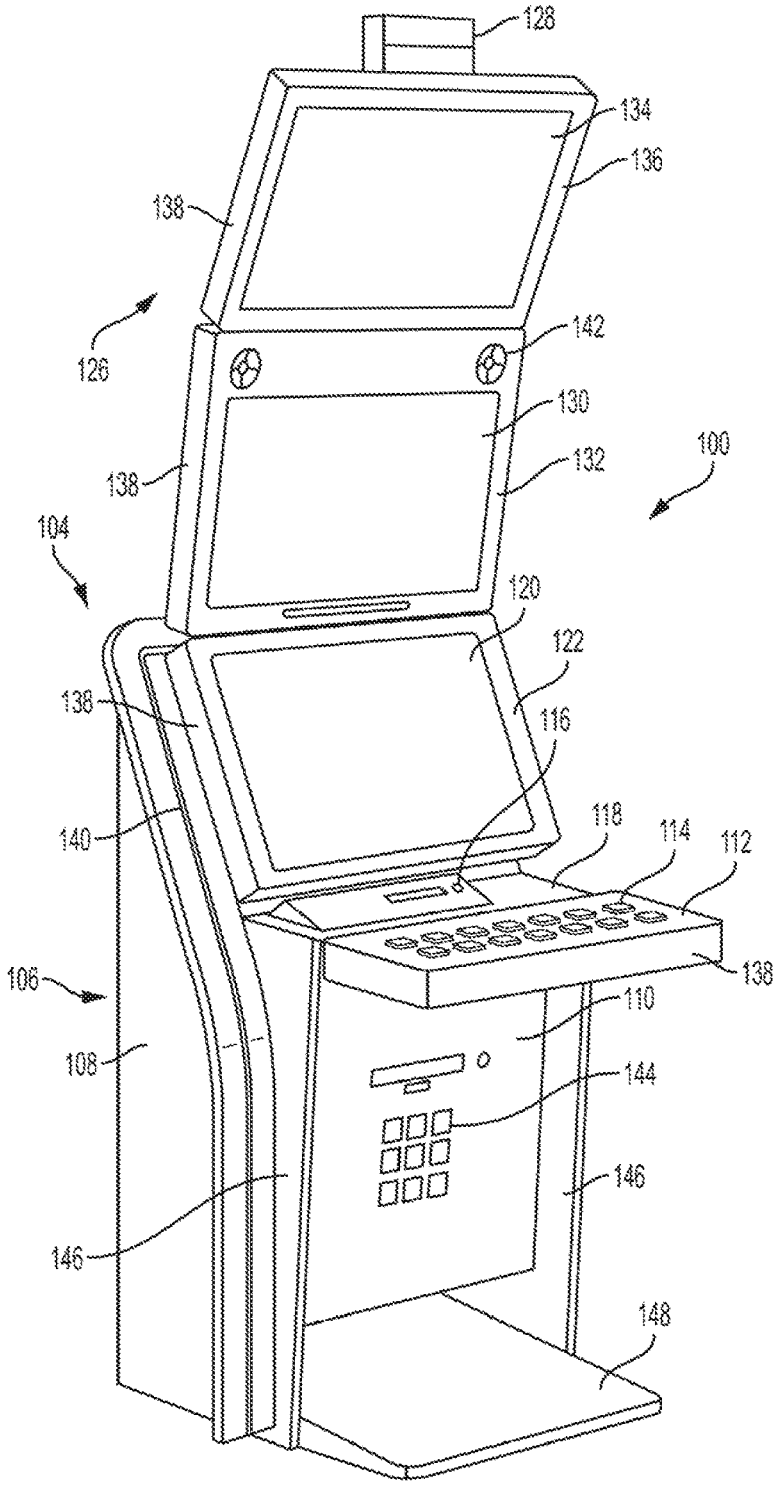
FIG. 1 is a perspective view of one embodiment of a stand-alone gaming device of a gaming system.

One embodiment of a gaming device platform is shown in FIG. 1 where a gaming device 100 is generally shown. In one embodiment, the gaming device 100 is referred to as a slot machine and is illustrated as housed in a housing or cabinet constructed so that a player can operate and play the gaming device 100 while standing or sitting.

Gaming device 100 may include cabinet 104 for housing the components fully described hereinbelow. The cabinet 104 has a lower cabinet body portion 106 which includes a pair of cabinet side panels 108 (only one of which is viewable in the perspective view of FIG. 1), front panel 110, and a rear panel (not shown). A base panel (not shown) and a top panel surface (not shown) that supports first display device 120 and the player interaction area 112, are provided. The cabinet panels are interconnected along their edges and cooperate to form a cabinet enclosure for housing the gaming device, as can be seen in FIG. 1.

It should be appreciated that a wide variety of cabinet enclosure sizes, shapes, and designs are possible for the gaming device 100. Cabinet 104 may function to securely protect any local control system, technology components, and provide support for display device(s) and player input and output interactions with the gaming device.

Returning to FIG. 1, the gaming device enables the player to interact with the gaming device 100 to direct the wagering and game play activities and preferences. Various forms of player interaction devices and activities will now be described.

Cabinet 104 includes a player interaction area having input and output areas generally designated as 112. The player interaction area 112 may be located on the front top side of cabinet 104 and, as shown, on a panel structure that extends outwardly from the gaming device in a player's direction. Player interaction area 112 may contain a plurality of player input and output structures such as player control button area 114, player value acceptor and dispenser area 116, and player convenience input area 118.

Player control button area 114 includes a plurality of buttons, touch sensitive areas, or both through with which players may interact with the one or more processors of gaming device 100 and direct game play. It is expected that cabinet 104 provides an easily accessible location and support for all necessary player input/output (I/O) interactions with the device, including gaming control interactions and value wagering interactions. Although the gaming device 100 illustrated in FIG. 1 shows player controls provided by buttons of player control button area 114, it is understood that in one embodiment, a player's gaming control interactions could be made by either buttons mounted on cabinet 104 or "soft" buttons located on the gaming display and activated by player touch (e.g., touch screen interfaces), or a combination of both arrangements.

Player control button area 114 may include, for example: game selection button(s) in any embodiments where more than one game is provided in a single gaming device; gaming denomination value selection button(s) in any embodiments where one or more wagering denomination value is accommodated; wager selection button(s) for the player to indicate or select the desired wager value for a game in any embodiments where a selection of wager values are offered; pay line selection button(s) for selecting the number of active pay lines in game embodiments that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information. As discussed above, the functions of the buttons in player control button area 114 may be duplicated with soft buttons in the player control button area 114 or as soft buttons in other areas of the gaming device 100 (e.g., as a touch screen overlay over available display devices).

Gaming device 100 may include one or more forms of value acceptance and value distribution to allow the player to interact with the device and to risk or otherwise place a wager (a monetary value) on one or more outcomes of a game. Winnings may be returned to the player via some form of value distribution. As illustrated in FIG. 1, player value acceptor and dispenser area 116 is provided. In the player value acceptor and dispenser area 116, a player supplies monetary value to the gaming device 100 via one or more value acceptor devices. In one embodiment, the player value acceptor and dispenser area 116 (through the one or more value acceptor devices) may accept any one or more of the following from a player to establish a gaming credit balance: coins, bills, tokens, tickets/vouchers, player ID cards, credit cards, or other suitable forms of value. Thus, if the gaming device 100 accepts coins and bill, the gaming device 100 includes a currency bill validator and a coin validator as the value acceptor devices. Likewise, if the gaming device 100 accepts tickets, the gaming device includes a ticket acceptor as a value acceptor device for receiving tickets or vouchers representing some monetary value. The ticket acceptor may include a bar code reader, or other appropriate code reader, for reading the encoded value contained by the player's ticket or voucher. In some embodiments, the player value acceptor and dispenser area 116 may include a value acceptor device that can accept more than one type of value. In some embodiments, the player value acceptor and dispenser area 116 may include multiple different value acceptor devices to accept different types of value from players Upon receipt of some type of value from the player, a value acceptor device of the player value acceptor and dispenser area 116 performs validation on the player supplied value using appropriate hardware readers (e.g., determining that the currency bills/coins/tokens are genuine or the ticket/voucher is genuine). If the validation result is positive on player supplied value, the appropriate value acceptor device generates a signal to a processor of the gaming device 100 to establish a gaming credit balance for plays of one or more games on gaming device 100.

In one embodiment, a player receives monetary value, or a representation thereof, from the gaming device 100 when a player chooses to "cash out" the gaming credit balance (e.g., remove value from the gaming device 100). The player can cash out at any suitable time. When a player cashes out the value contained on a credit meter (not shown) of gaming device 100, a processor of gaming device 100 may cause a printer of gaming device 100 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming device 100 may cause a currency bill dispenser or a coin dispenser in gaming device 100 to dispense the value contained on the credit meter of gaming device 100.

Various combinations of the above value acceptance and value distribution arrangements are possible. Gaming device 100 may include other value acceptance and value distribution mechanisms in the player value acceptor and dispenser area 116. For example, gaming device 100 may include a magnetic strip or chip card reader/writer in order to accept value from and transfer value to a magnetic strip or an embedded chip card. In other embodiments, hardware for transferring (and receiving) non-traditional currencies to players such as digital currencies (e.g., bitcoin) may be included in gaming device 100.

In an alternative embodiment, gaming device 100 may include a card reader (not illustrated) in the in the player value acceptor and dispenser area 116, which accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming device may be associated with the player account. It is noted that a numeric or alphanumeric keypad may be provided adjacent to the card reader slot to enable player entry of a personal identification number or the like for secure access to card information.

In one embodiment, a player convenience input area 118 may be included in the gaming device 100, as is shown in FIG. 1. In various embodiments, player convenience input area 118 may have a variety of features and functions depending on the jurisdictional deployment of the gaming device 100. In one embodiment, the player convenience input area 118 will house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into a gaming device during play. These player loyalty/player tracking cards are associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain embodiments, the player convenience input area 118 may include player convenience features such as a pocket for storage that allows players to store their personal items such as a mobile phone. Gaming device 100 may include one or more universal serial bus (USB) ports that enables a player to charge their electronics or connect to services such as the Internet or food service. Further, player convenience input area 118 of gaming device 100 may include buttons to request food or drink service if the gaming device is located in an establishment that has food and drink service. The gaming device 100 may be connected to a local or wide area network such that selection of the requested food or drink service will alert the establishment's hospitality staff to deliver the requested service directly to the gaming device 100.

The layout of the player control button area 114, player value acceptor and dispenser area 116 and the player convenience input area 118 in gaming device 100 may be arranged differently than those disclosed and illustrated herein. The selections and arrangement of input locations on the cabinet 104 may be dependent upon the game buttons, the type of value wagered, and the player conveniences utilized in the deployment configuration of gaming device 100.

With continuing reference to FIG. 1, in one embodiment, lower cabinet body portion 106 includes a first display device 120 mounted atop or flush with the lower cabinet body portion's top panel surface. First display device 120 is, for example, a 27-inch liquid crystal display (LCD) display mounted in a widescreen orientation. However, any suitable display may be used in any suitable orientation. In the illustrated embodiment, the first display device 120 is mounted within and framed by first display frame 122 which is, in turn, mounted upon lower cabinet body portion's top panel surface. In this manner, the first display device 120 is both surrounded and secured within the first display frame 122 and raised above the cabinet's top panel surface. Additional features of the first display frame 122 will be described below. In one embodiment, gaming device 100 may use one first display device 120 and not include additional display devices (not illustrated).

The lower cabinet body portion 106 is further constructed to support upper cabinet portion 126. Upper cabinet portion 126 may be comprised of an upwardly extending support structure (not illustrated) that extends upwardly from the rear side of lower cabinet body portion 106 and is sufficiently strong to support one or more additional display devices.

At the topmost end of the support structure, a cabinet top light 128 may be provided. The cabinet top light 128 is capable of illumination in a variety of colors and is utilized to indicate and communicate gaming device conditions to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In one embodiment, as illustrated in FIG. 1, gaming device 100 includes two additional displays, second display device 130 and third display device 134. Second display device 130 and third display device 134 are disposed generally in a vertical relationship and generally in alignment with the first display device 120. Like the first display device 120, second display device 130 and third display device 134 can be 27-inch LCD displays and can be mounted in a widescreen orientation in one embodiment. However, any suitable display in any suitable orientation may be used for the second display device 130 and the third display device 134. Further, like the first display device 120, second display device 130 and third display device 134 can be mounted within and framed by second display frame 132 and third display frame 136, respectively. Second display frame 132 and third display frame 136 are attached to the upper cabinet support structure and can protect the second display device 130 and the third display device 134.

First display device 120, second display device 130, and third display device 134 can be disposed at an angle from each other to form a player-facing concave arc. However, in some embodiments, the angles between the displays may be adjustable and may be smaller or greater than the angles illustrated in FIG. 1. Further, it is understood that in some embodiments the displays may be disposed in a common plane relative to each other.

It also should be appreciated that in various embodiments a variety of display technology may be utilized equivalently and interchangeably with a variety of embodiments of the gaming device. Equivalent display devices include all variations of liquid crystal displays, light emitting diode displays, and plasma displays.

In some embodiments, different sized displays may be combined to display gaming data on gaming device 100. As a non-limiting example, a 27-inch widescreen LCD display may be combined with a 20-inch portrait oriented LCD or a light emitting diode (LED) display. This combination may be used, for example, with a third scrolling banner LED display. In alternative embodiments, one, two, three, or more displays could be used in a variety of positions and orientations. Any suitable combination may be used. It should also be appreciated that a processor of gaming device 100 may communicate with the disclosed first display device 120, second display device 130, and third display device 134 through a video card of gaming device 100 to produce the visible aspects of a game.

In one embodiment, one or more of the first display device 120, second display device 130, and third display device 134 may be fitted with a transparent touch sensitive overlay for sensing player touch inputs into the gaming device. Touch sensitive overlays can communicate with a processor of gaming device 100 to enable the player to interact with the game.

In some embodiments, the curved displays may be used for any or all of the first display device 120, second display device 130, or third display device 134. Similarly, any of the displays used for gaming device 100 can be based on flexible display technologies. For example, it is possible to utilize flexible display technologies to create uniquely shaped curving, wavy, or tubular display structures to provide one or more of the first display device 120, second display device 130, and third display device 134. Additionally, in one embodiment flexible display technologies can be used in combination with fixed flat screen technologies.

While the gaming device 100 has been described as implemented with video technologies, in one embodiment, mechanical reels with reel strips containing game indicia and step motor controllers may be employed to provide game information to a player. In one embodiment, the reel strips may include a plurality of printed symbols. In another embodiment, the mechanical reels may include flexible video display technology as the reel strips on mechanical reels. Thus, games implemented in video form can readily be implemented with mechanical reels utilizing such display technology. Alternatively, in other embodiments mechanical reels with reels strips having fixed symbols displayed along the reel strip could be used to implement the game.

Dependent upon the particular gaming device housing style, a variety of other display technologies may be utilized in combination with the gaming device disclosed herein. For example, in some embodiments a gaming device may have one or more display devices in addition to the main display device(s). For example, the gaming device may include a player tracking device having a player tracking display which displays various information to the player regarding the player's status. The gaming device may also include other game-related displays such as the wager display and the gaming credit balance display. These additional game-related displays may be separate display devices or may be displayed on any one or more of the first display device 120, the second display device 130, or the third display device 134.

Cabinet lighting design functions to attract players to a gaming device 100. In the embodiment of FIG. 1, attractive cabinet lighting is provided by frame accent lighting 138. It is noted that frame accent lighting 138 is a common structure found on each of the first display frame 122, the second display frame 132, and the third display frame 136 and player interaction area 112. Example areas where frame accent lighting is applied to gaming device 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In one embodiment, the circuit boards are flexible circuit boards. These LED strips and transparent or translucent coverings may surround one or more gaming device displays frames, as well as the player interaction area, to highlight these areas.

In one embodiment, the individual LEDs mounted on the LED strips are of a type that can emit red, green, and blue light. In an alternative embodiment, separate LEDs are used for each required light color. All LED strips can be electrically connected and can be controlled by a cabinet lighting controller 218 (illustrated in FIG. 2) in conjunction with a processor of gaming device 100 to selectively mix the emitted light colors in a manner to create any color. The cabinet lighting controller 218 can flash and vary lighting as desired. For example, cabinet edge lighting can change and flash in combination with music rhythms or in combination with game events. Other variations are possible.

In some embodiments, cabinet 104 may include LED strip lighting or LED rope lighting to accentuate the cabinet and enhance the attractiveness of gaming device 100 to players. LED rope lighting is a plurality of small light-emitting diode bulbs linked together and encased in a plastic, polyvinylchloride, or other suitable material to create a string of lights. For example, in the embodiment of FIG. 1, cabinet 104 includes cabinet accent lighting 140. In one embodiment, cabinet accent lighting 140 is LED rope lighting mounted flush with the front side edge of the cabinet side panels 108. The LED rope lighting can generate any of suitable colors, and are controlled by cabinet lighting controller 218 and a processor of gaming device 100 to selectively mix the emitted light colors in a manner to create any color in the same manner as the frame edge lighting.

In various embodiments, gaming device 100 includes one or more audio speakers and appropriate driving electronics and sound cards so that game players may experience pleasing audio aspects of the gaming device 100. Audio is desirable to attract and maintain player interest in gaming device 100. Gaming device 100 may also emit attraction sounds during any idle period of gaming device 100. Game audio may add to the player's enjoyment of gaming device 100 by providing music and sound effects designed to enhance and compliment the gaming experience.

Audio speaker hardware may include one or more speakers disposed in or on the cabinet 104 of gaming device 100. In FIG. 1, a pair of audio speakers 142 are shown mounted on the upper corners of second display frame 132. Any suitable number of additional speakers may be provided on additional display frames or on the lower cabinet body portion 106 as desired.

Speakers designed for emitting bass vibrations may be included in some embodiments. Speaker placement may be selected to enhance the sound emitting characteristics of the gaming device. For example, bass speakers or additional speakers 144 may be mounted inside lower cabinet body portion 106. Further, it is envisioned that in some embodiments sound processing such as multichannel processing and surround sound processing are included in gaming device 100. Audio jacks for attachment of player headphones may also be provided in some embodiments of gaming device 100 for the player to further enhance the audio experience of the game and also to block out noise from other gaming devices.

In one embodiment, front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing gaming device 100 in a seated position. Foot rest 148, which may be cushioned, is provided below player interaction area 112 to enhance a player's ergonomic comfort while playing gaming device 100. In one embodiment, the edges of player interaction area 112 may be ergonomically cushioned as well.

Gaming device 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary 3) provide an easy location and support for all necessary player input/output (I/O) interactions, including gaming control interactions and value wagering interactions. For example, in some embodiments the gaming device 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In one embodiment, housing styles of cabinet 104 of gaming device 100 may include bar top or table top housing arrangements. These housings are generally small enough to be placed on top of an existing bar or table while providing the requisite gaming device housing functions of protection of/access to gaming electronics, displays, and player I/O functions described above.

In one embodiment, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
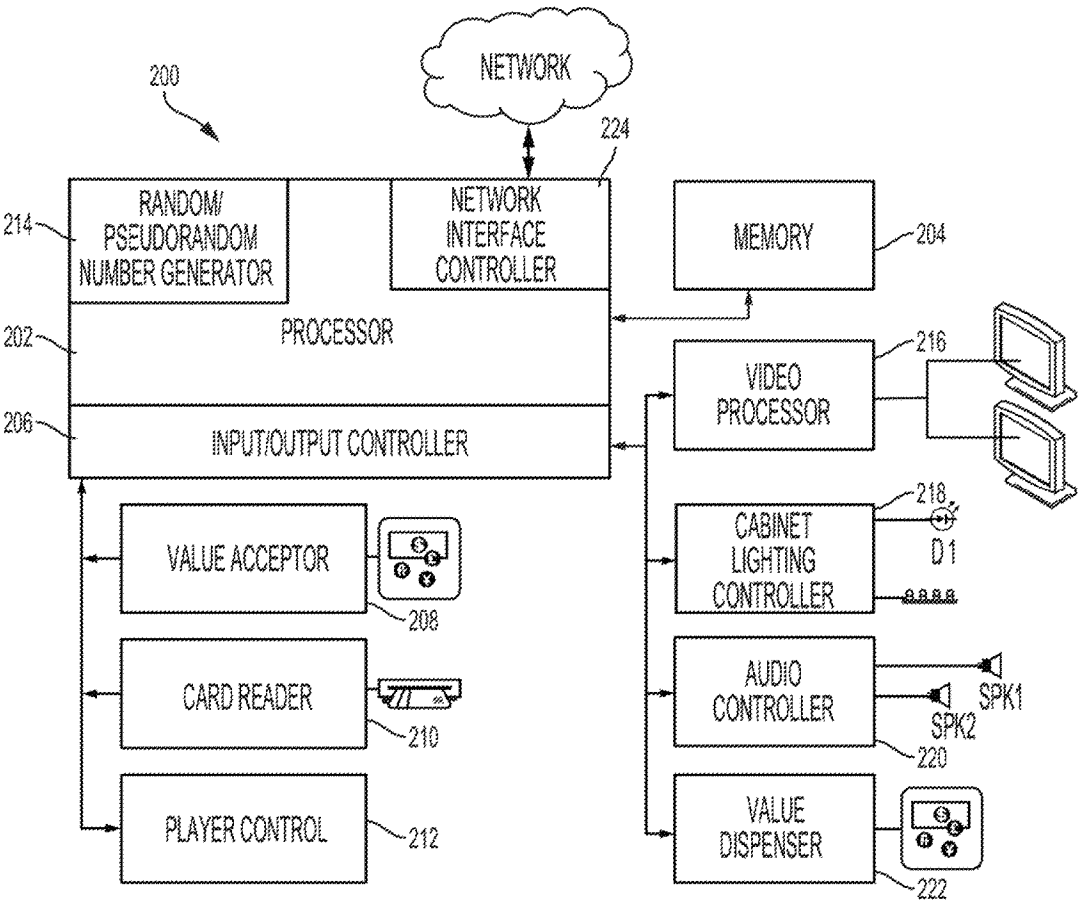
FIG. 2 is a functional block diagram of the gaming device technology components of the gaming system.

Turning now to FIG. 2, the features and advantages of the gaming system described above will now be described in terms of the various technology components for allowing player interaction with the gaming device 100.

FIG. 2 illustrates a functional block diagram of an embodiment of technology components of gaming device 100 that are specially configured to carry out the game function and operations described herein. The functional elements shown in FIG. 2 cooperate, on a broad and general level, to function as gaming device 100. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In one embodiment, gaming device 100 is functionally controlled by control unit 200. Control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one embodiment, control unit is also configured to communicate with a server device through a network.

In one embodiment, control unit 200 includes at least one specially configured processor 202 or central processing unit (CPU). In one embodiment, specially configured processor 202 include arithmetic logic units and math co-processors also known as floating point units. In one embodiment, specially configured processor 202 includes registers for holding instructions or other data, and cache memory for storing data for faster operation thereupon. In one embodiment, specially configured processor 202 may be a multi-core processor that includes two or more processors for enhanced performance, more efficient parallel processing, or other advantageous computing functions. In another embodiment, specially configured processor 202 may be one or more processing devices such as microprocessor(s) or integrated circuit(s) and may include one or more controllers. It should be appreciated that in some embodiments, a general purpose processor could be programmed to perform the functions of specially configured processor 202.

A controller, in one embodiment, is a device or a software program that manages or directs the flow of data between two entities. Often, controllers are special purpose circuitry or software that solve a technical communications problem between different technology systems. In one embodiment, a controller functions as an interface between two systems while managing the communications between the systems. In another embodiment, a controller functions as an interface between a processor and a peripheral device and functions to control the peripheral device.

At least one specially configured processor 202 or controller of control unit 200 is specially configured to communicate with at least one memory device, generally shown as memory device 204 in FIG. 2. In one embodiment, memory device 204 includes one or more memory structures for storing instructions and various types of game data. Memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in one embodiment, communication with a memory device by a processor or a controller encompasses the processor or controller accessing the memory device, exchanging data with the memory device, or storing data to the memory device.

Memory device 204 may store all program code and game code (collectively the "code"), and operation data necessary for the operation of the gaming device 100 and execution of the gaming features described hereinbelow. In an alternative embodiment, game code and operation data necessary for the operation of the gaming device 100 may be store in a distributed manner such that some code is stored in memory device 204 and other code is stored remotely from gaming device 100. In one embodiment, the code and operation data necessary for the operation of the gaming device includes, for example, basic input and output function data, instruction fetching data, bus and network communication protocol data, and like data necessary for an operational gaming device 100. In one embodiment, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in one embodiment, the code and operation data for the operation of the gaming device described above may be stored in removable game cartridges or flash drives, a compact disk ROM, a digital versatile disk (DVD) optical storage technology, or suitable other fixed non-transitory storage mediums. In another embodiment, part or all of the code and operational data for operation of the gaming device or for execution of the game features may be stored in a remote memory structure and be downloaded to the memory device 204 via a network connection.

In one embodiment, the gaming device 100 may utilize any combination of memory devices such as random access memory devices (RAMs), unalterable memory devices (ROMs), and mass storage devices for securely storing and securely communicating the software components or code that facilitate game play and other functions of the gaming device 100. The memory devices may store software components or code that include various game data and game related control and execution software. In some embodiments, the software components stored in the memory devices may include gaming system initialization software, system basic input and output software, operating system software, value acceptor software, value dispenser software, display image generation software, game symbol set image generation software, game rule execution software, game data set(s), random number generation software, system driver software, system data bus management software, audio generation and speaker driver software, and video generation and display driver software, and any other suitable software routines for operation of the gaming device 100.

In some embodiments, the memory devices, such as memory device 204, with the software components and other data may be secured and authenticated by authentication software stored in an unalterable memory device within the housing of gaming device 100. The gaming device 100 may also include application specific integrated circuits (ASICs) to perform the security and authentication functions. At any appropriate time, such as before each play of a game, at a predetermined interval, upon transfer of any game data or any software components from a mass storage to memory device 204, or upon demand, the gaming device 100 (using a processor such as processor 202 or a separate ASIC) may execute an authentication routine and perform an authentication of any software component or other data of the gaming device 100. In one embodiment, the gaming device software components may be prepared for authentication via creation and storage of an encrypted signature unique to one or more of the software components.

In one embodiment, an encrypted signature may be created by utilizing a hash function on a software component or code to form a message digest (i.e., a hash of the software component) followed by a key encryption of the message digest to form an encrypted signature unique to the software component. In some embodiments, the key encryption may be public key encryption, private key encryption, or any suitable key encryption schema. The encrypted signature may be stored with the gaming device software component, for example, in a mass storage device or an unalterable memory. During a software component authentication, the gaming device 100 executes one or more authentication routines utilizing the same hash function to operate on the software component to compute, or re-create, a new message digest for the software component. The new or re-created message digest may then be compared with a previously created message digest obtained by decrypting the stored encrypted signature. Matching message digests between the new and previously created message digests indicate that the software component is authentic and gaming device 100 may allow game play to proceed. However, when the message digests do not match, the gaming device 100 may determine that the software component under authentication may be corrupted or fraudulent and game play may be halted. It should be appreciated that the gaming device 100 may perform other suitable security and authentication checks on the game data or software components. Such authentication and security devices and functions are unique to gaming and casino industry to minimize or prevent fraud in gaming devices and gaming systems.

For a player to interact with gaming device 100, control unit 200 receives and processes player inputs, and control unit 200 causes processed results to be output or communicated to the player. In one embodiment, player inputs are recognized and processed or directed for processing by input/output (I/O) controller 206. Further, I/O controller 206 may process and direct player outputs for communication to the player. I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for each attached input device and output device. In this manner, specially configured processor 202 is freed from the operational details of the peripheral I/O devices. For example, in one embodiment where an input or output device is changed or upgraded, I/O controller 206 can be changed without changing other gaming system 100 components.

In one embodiment, a player deposits value into gaming device 100 by inserting some form of currency into a value acceptor 208 for game play. Alternatively, a player deposits value into gaming device 100 by inserting an encoded paper ticket into a value acceptor 208 for game play in one embodiment. Value acceptor 208 can be combined with a currency reader and validator, and a code reader for reading value encoded on paper tickets. Value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming device 100. During game play, each time a player risks a wager on an outcome, specially configured processor 202 processes the wage and determines the amount of credits to debit from the player's credit balance. When a winning outcome is obtained, specially configured processor 202 is configured to determine the amount of credits to add to the player's credit balance.

As previously mentioned with respect to FIG. 1, a variety of value acceptance arrangements are possible. In one embodiment, the value acceptor 208 could include magnetic strip or chip card readers to accept and transfer value. Value acceptor 208 may also be configured to accept and transfer non-traditional currencies such as digital currencies. In these embodiments, I/O controller 206, a specially configured processor 202, or both contain appropriate control instructions to communicate and extract value from the inserted item containing value. In one embodiment, use of a magnetic strip or embedded chip card, for example a bank card, for value insertion requires specially configured processor 202 to communicate, via network interface controller 224 (described below), with devices external to the gaming device 100.

In one embodiment, card reader 210 may be included in gaming device 100 to accept player loyalty cards. For example, card reader 210 can extract account identifying information from the card and utilizes this information to access the associated account information stored remotely via network interface controller 224. In embodiments where player loyalty/player tracking systems are employed, a player's loyalty account and record of gaming activity can be stored in a networked storage location or database. Specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various embodiments, player control 212 receives a player's game inputs and communicates the player's game inputs to specially configured processor 202. The player's game inputs may include, but are not limited to, wager amounts, pay line selections, game control signals, and cash-out signals. The player control 212 may generate signals based on button presses, touch screen activations, or voice control. The player initiated signals are propagated to the specially configured processor 202 by I/O controller 206. Further, the player initiated signals may direct and inform execution of the game instructions stored in memory device 204 and configured to be executed by specially configured processor 202.

In one embodiment, specially configured processor 202 is configured to execute stored program code and instructions which generate random numbers or pseudo-random numbers. In one embodiment, as illustrated in FIG. 2, a random number generator (RNG) 214 is a software module configured to be executed by specially configured processor 202 for the generation of a true random or pseudo-random number. The code for RNG 214 may be stored in memory device 204. RNG 214 generates random numbers for use by the gaming software during game execution. In one embodiment, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various embodiments, once random symbols are selected based upon the random number generated by RNG 214, patterns of symbols are compared to determine wagering outcomes. In an alternative embodiment, gaming device 100 may include a hardware based random number generator that is in communication with specially configured processor 202 to supply random numbers for game generation purposes. The hardware based random number generator may be incorporated into specially configured processor 202 or can be separate from specially configured processor 202.

In yet another embodiment, random generation of "numbers" or symbols may be performed with electro-mechanical components. For example, gaming devices such as gaming device 100 may incorporate a plurality of mechanical reels rotatable about a common axis. A plurality of indicia or symbols may be positioned around the periphery of the plurality of reels. Each of the indicia or symbols on each reel may indicate separate detectable reel stop positions. The reels can be set into a spinning/rotation motion by pulling a lever or pushing a button. In some embodiments, the gaming device 100 can stop the reels by the gaming device 100 actuating, on a random timing basis, a suitable mechanical or electro-mechanical reel brake. When the reels stop rotating, one or more displayed stop positions of each reel is detected. Since the stop positions are each associated with an indicia or symbol, the gaming device can determine whether the combination of stop positions (i.e., translating to a combination of displayed symbols) results in a winning symbol combination.

Returning to FIG. 2, control unit 200 controls the function and output of a plurality of output devices utilized by gaming device 100. In various embodiments, I/O controller 206 serves as an interface unit between specially configured processor 202 and output devices such as video processor 216, cabinet lighting controller 218, audio controller 220, and value dispenser 222.

In one embodiment, video processor 216 communicates with specially configured processor 202 to render all game graphics, video displays, and information on gaming device 100's one or more video display units. In one embodiment, video processor 216 includes one or more processors, controllers, and/or graphics cards for processing the game images, outcomes, and animated displays and coordinating the processed data to be display between, among, or across any or all display devices. In various embodiments, this may include being configured to simulate objects and the movement of objects which represent video reels containing sets of gaming symbols.

It should be appreciated that in certain other embodiments where physical mechanical reels are utilized by the gaming device 100 as a display devices, reel controllers and stepper motors would be provided in lieu of or in addition to video processor 216.

In embodiments which utilize cabinet lighting as described with respect to FIG. 1, a cabinet lighting controller 218 may be utilized to coordinate and control the color and timing of cabinet lighting displays with specially configured processor 202. In certain embodiments which utilize sound design, specially configured processor 202 may utilize audio controller 220 to coordinate and control the sound emissions. In one embodiment, audio controller 220 may include one or more audio processing cards for generating sound and for driving the one, two or more speakers that may be included with gaming device 100.

In various embodiments, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In one embodiment, value dispenser 222 can be controlled to issue the player's credit value using any of the types of value discussed herein. In some embodiments, the player's credit value may be issued to the player via a printed and dispensed encoded paper ticket or token which the player can then exchange at a special purpose kiosk or cashier location for the monetary value encoded into the ticket or token. In some embodiments, the specially configured processor 202 can direct the value dispenser 222 to issue to the player an appropriate amount of coin or bills directly to the player. Additionally, or alternatively, in some embodiments, the player may have the option to electronically direct the credit value to an account associated with the player.

In some embodiments, control unit 200 of gaming device 100 may communicate with one or more devices outside the gaming device 100. For example, gaming device 100 may be connected to a larger gaming network via a local area network (LAN) or a wide area network (WAN). Control unit 200 may communicate with one or more central servers, controllers, or remote devices to execute games, establish credit balances, participate in jackpots, etc. In such embodiments, network communications and connections are accomplished via a network interface controller 224. Network interface controller 224 can be a digital circuit board or card installed in control unit 200 to provide network communications with external devices.

In some embodiments, various additional features and functions are performed by control unit 200. For example, control unit 200 may be specially configured with appropriate software to track all game play events that occur on gaming device 100. In some embodiments, control unit 200 may audit all recorded monetary transactions, including all wager amounts, game outcomes, game winnings, and game payouts that occur through gaming device 100. Further, some embodiments may include security software to assist in protecting the gaming device 100 from tamper or alteration attempts.

Gaming System Operation

Figure 3A:
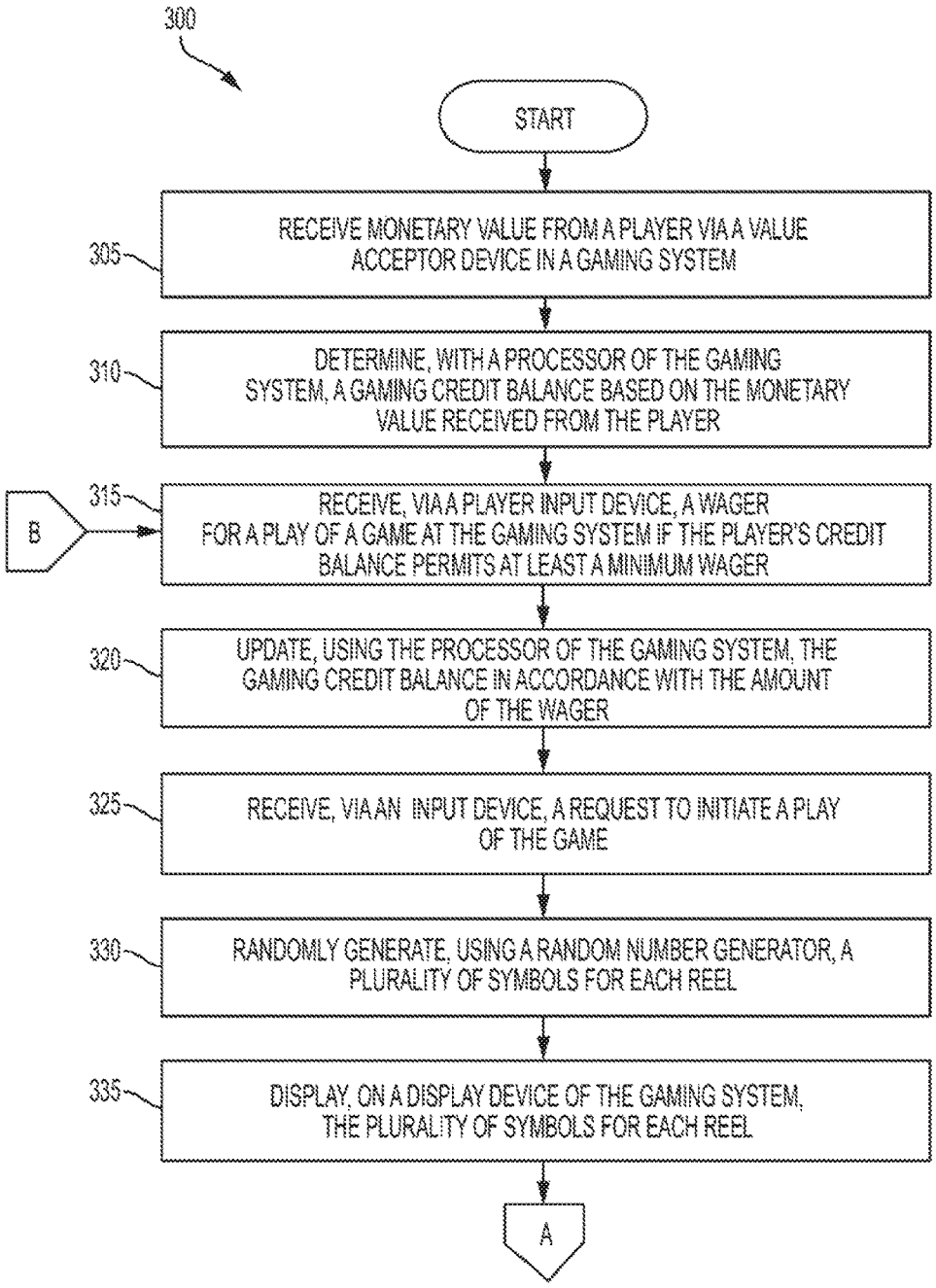
FIGS. 3A, 3B, 3C, and 3D illustrate a flow diagram of one embodiment of operating the gaming system that includes placeholder symbols and replacement symbols.
Figure 3B:
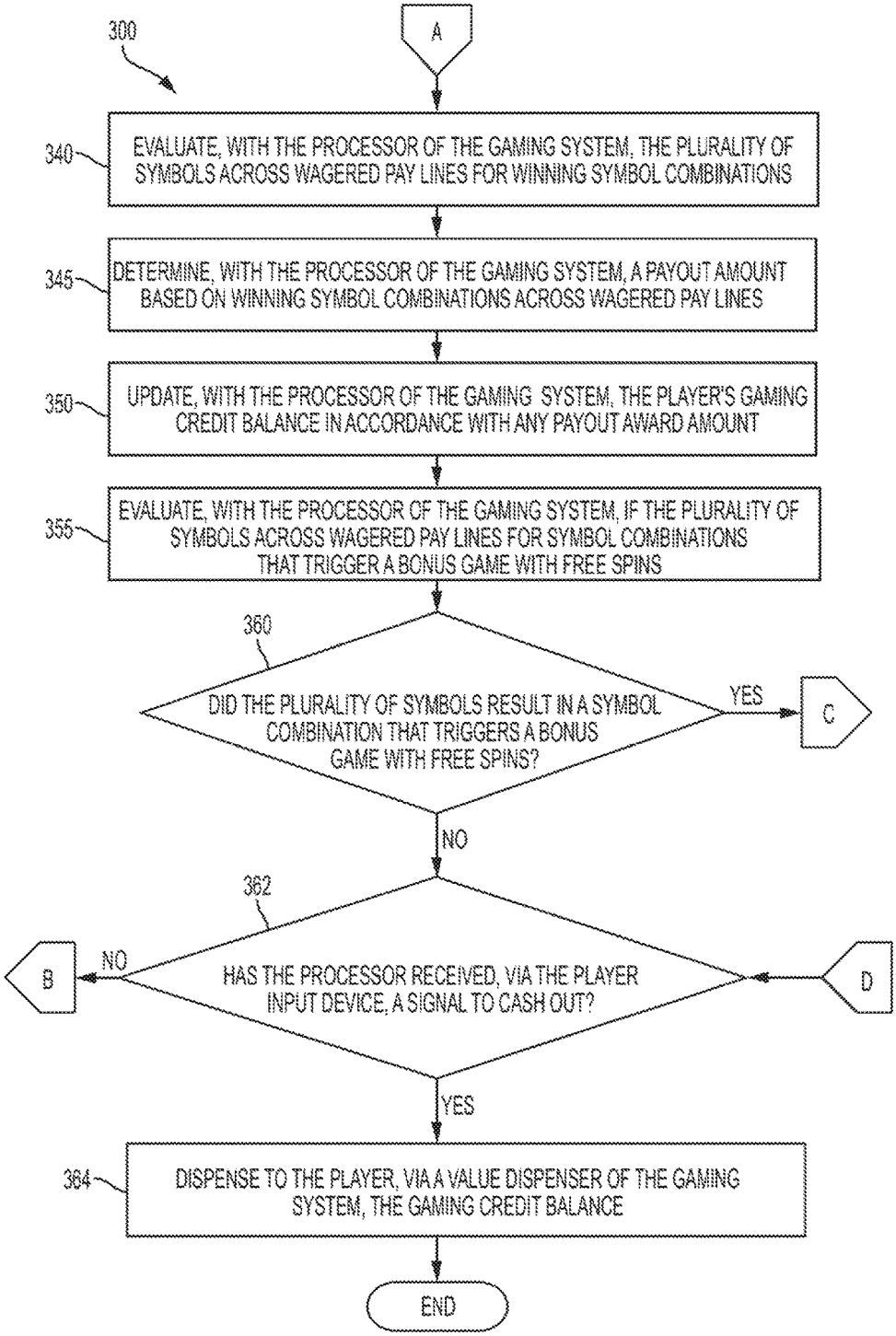
Figure 3C:
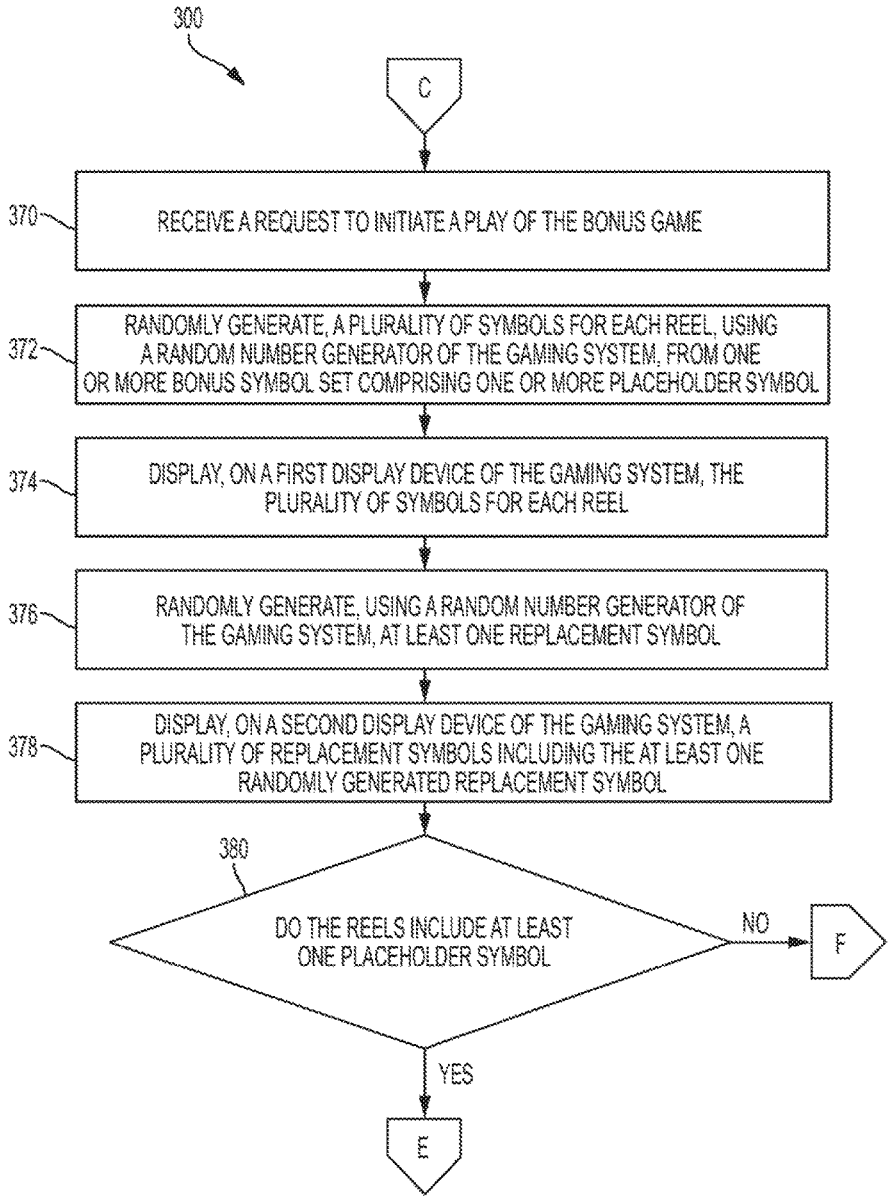
Figure 3D:
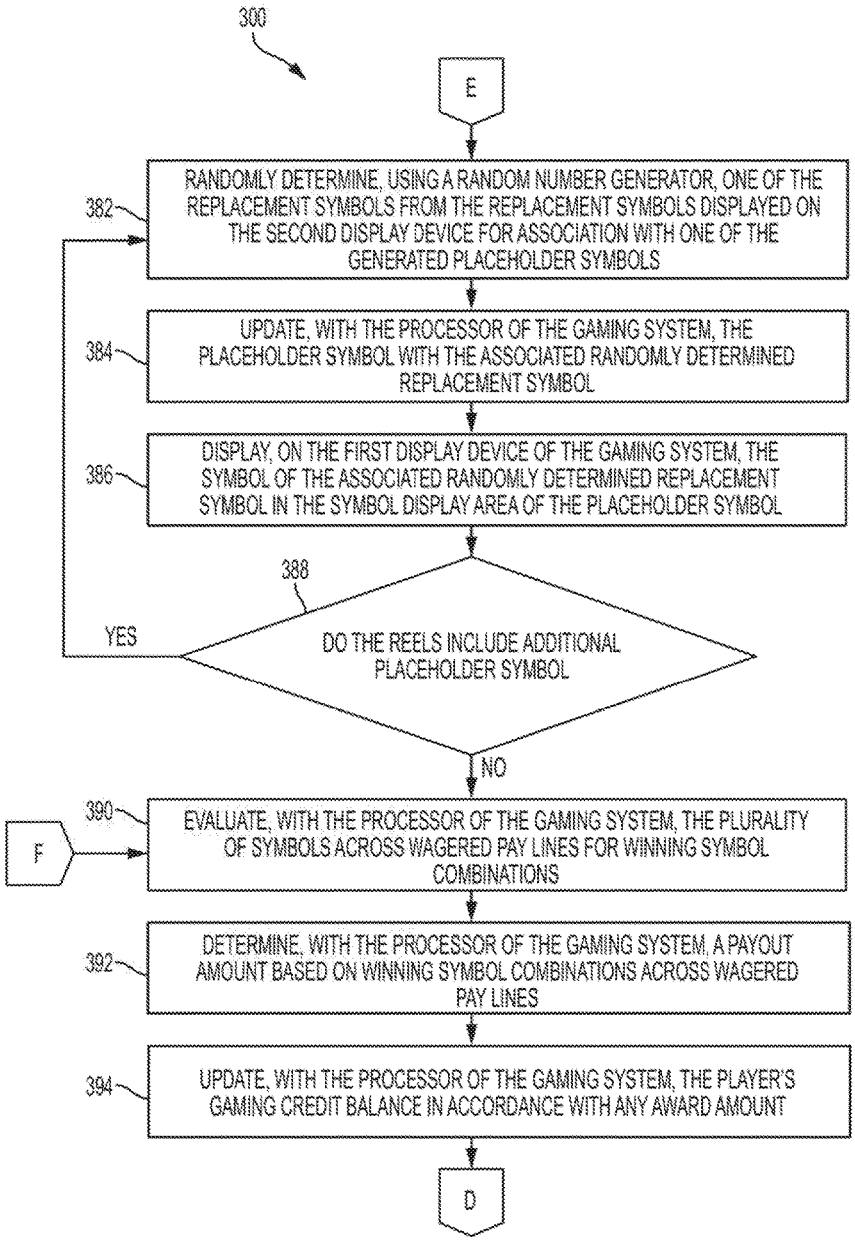

FIGS. 3A, 3B, 3C, and 3D illustrate a flowchart of an example operation 300 of one embodiment of the gaming system and method. FIGS. 3A and 3B are depicted as a base or primary game while FIGS. 3C and 3D are depicted as a bonus game. However, it should be appreciated that FIGS. 3C and 3D may be integrated as part of a base game without entering a separate bonus game.

In one embodiment, a processor of the gaming system is configured, via instructions stored in a memory device, to perform the operation 300. However, it should be appreciated that other suitable variations of operation 300 are possible. For example, in one embodiment, fewer or one or more additional blocks (not shown) may be employed in operation 300 of the gaming system and method. In other embodiments, the blocks may be performed in any suitable order.

FIG. 3A illustrates one embodiment in which the gaming system receives a monetary value from a player to initiate operation 300. As indicated in block 305, the gaming system may receive monetary value via a value acceptor device associated with the gaming system. The value acceptor device, in one embodiment, is disposed in a gaming system or in communication with the gaming system as discussed above.

In one embodiment, the gaming system determines a credit balance based on the monetary value received from the player at a value acceptor device as indicated in block 310. The gaming system determines, via a processor, a gaming credit balance for the player. The gaming credit balance may be based on the monetary value received from the player at the value acceptor device.

In one embodiment, the gaming system may receive a wager for a play of a game at the gaming system. Block 315 of FIG. 3A illustrates one embodiment where the player's wager is received via a player input device. The gaming system may allow a player to place a minimum wager, a maximum wager, or any suitable wager amount. Depending on the wager amount, the gaming system may also enable the player to select pay lines across displayed symbol positions (e.g., symbol display areas) on reels in a game in which to place wagers. Although in some embodiments, the gaming system selects the wagered pay lines automatically based on the player's wager. Wagered pay lines may be referred to herein as active pay lines. In one embodiment, the gaming system may determine whether the player provided enough credits to enable the player's selected wager. The gaming system may prevent the player from placing the wager and starting a play of a game if the player's credit balance is not large enough to support the player's selected wager. If enough credits are not available in the player's credit balance, the gaming system enables the player to insert additional value to obtain the minimum credit level or to cash out of the gaming system.

In one embodiment, the gaming system may use a processor of the gaming system to update a gaming credit balance. The credit balance may be updated in accordance with the player's wager amount as indicated in block 320. In some embodiments, the credit balance is not updated until a later time.

Block 325 illustrates one embodiment in which the gaming system may receive a request to initiate a play of a game. The request to initiate the play of the game may be received from a player via a player input device in communication with the gaming system. The gaming system may securely access game data from a memory device and execute an authentication routine on the game data to start a play of a game as discussed above. For example, the player may press a spin button on the gaming system to start spinning slot machine reels of the gaming system (or randomly generating symbols using other methods discussed above for virtual reels) for the play of the game. It should be appreciated that reels used throughout the specification may refer to mechanical reels, electro-mechanical reels, or virtual video reels (where virtual reels strips or no reel strips are used). It should further be appreciated that although many examples illustrated in the specification describe the games in terms of slot machines with reels, other games may be used, including games without slot machine reels.

In one embodiment, the gaming system may use a random number generator to randomly generate a plurality of symbols from a plurality of sets of symbols as indicated in block 330. In some embodiments, the gaming system may generate the plurality of symbols for display on a set of reels (or virtual reels). In some such embodiments, each reel is associated with its own set of symbols. As used herein, the random number generation may refer to pseudo-random or true-random number generation depending on the module used for the random number generation.

In one embodiment, the gaming system may cause a display device to display the plurality of symbols generated as indicated in block 335. In a game using reels, the gaming system may display the generated plurality of symbols in visible symbol display areas of each of the reels. Off page connector A refers to FIG. 3B to continue operation 300.

Turning now to FIG. 3B and off page connector A, in one embodiment as shown in block 340, the gaming system evaluates the generated plurality of symbols across active or wagered pay lines for winning symbol combinations. In some embodiments, the gaming system evaluates the winning symbol combinations based on the pay lines wagered upon by a player. The gaming system may evaluate the player selected pay lines, gaming system assigned pay lines, or pay lines assigned as active in some other manner for the play of the game. In one embodiment using reels, the gaming system determines an award amount based on winning symbol combinations formed across the reels on active pay lines. For example, if a pay table associated with the gaming system indicated that at least three of the same bar symbols is a winning symbol combination and awards a predetermined payout, the gaming system would evaluate the generated plurality of symbols for bar symbols. If the gaming system generated at least three bar symbols on adjacent reels and along an active pay line, the gaming system may determine that the three bar symbols is a winning symbol combination based on the predetermined pay table. It should be appreciated that a pay table may include any suitable number of winning symbol combinations and payouts. In one embodiment, a pay table may indicate that as few as one symbol may be associated with a payout. Alternatively, two or more symbols may be used to form winning symbol combinations that result in a payout.

In block 345, the gaming system determines, with the processor, a payout amount based on the evaluated winning symbol combinations across wagered pay lines. As illustrated in block 350, the gaming system may update, with the processor, the player's gaming credit balance in accordance with any award amount. As noted above, the blocks illustrated in FIGS. 3A-3D can be rearranged in any suitable order. As such, it should be appreciated that the gaming system may update player's gaming credit balance at other suitable times.

In one embodiment, as indicated in block 355, the gaming system evaluates the plurality of symbols across wagered pay lines for symbol combinations that trigger a bonus game with free spins. It should also be appreciated that in some embodiments, events other than generating one or more of a predetermined symbol may trigger the bonus game. If the gaming system determined that the generated plurality of symbols did not result in triggering a bonus game, in block 360, operation 300 moves to block 362. In one embodiment, as indicated in block 362, the gaming system may receive a signal to end game play or "cash out" via an input device of the gaming system. In such a situation, the gaming system dispenses a value to the player, through a value dispenser, based on the player's gaming credit balance as illustrated in block 364 and operation 300 ends.

On the other hand, if the gaming system processor has not received a signal to end game play via the player input device, the process of operation 300 returns to block 315 via off page connector B. The gaming system may receive, via a player input device, a wager for another play of the game and continue operation 300 from block 315. However, in one embodiment, the wager may not be accepted if the player has fewer credits than the player's selected wager amount as shown in block 315.

Returning now to block 360, if the gaming system determined that the generated plurality of symbols resulted in trigging a bonus game, operation 300 moves to block 370 in FIG. 3C via off page connector C. In one embodiment, if the gaming system determines that the generated plurality of symbols includes one or more generated predetermined symbols, the gaming system will trigger or activate the bonus game. In one embodiment, the predetermined symbol is a symbol that serves one function: to trigger the bonus game. In alternative embodiments, the predetermined symbol serves a plurality of game functions, such as triggering the bonus game and providing an award value. Other suitable game functions may be associated with the predetermined symbol.

In some embodiments, the gaming system alters the play of the game during the bonus game. In some embodiments, the gaming system may change how symbols operate. In some embodiments, the gaming system may use different pay tables in the bonus game to calculate winning symbol combinations.

Block 370 of FIG. 3C illustrates one embodiment in which the gaming system may receive a request to initiate a play of the bonus game. As noted above, the features discussed in connection FIG. 3C may also be applied to base games or games that are not bonus games. The request to initiate the play of the bonus game may be received from a player via a player input device in communication with the gaming system. For example, the player may press a spin button on the gaming system to start randomly generating symbols for the play of the bonus game. In an alternative embodiment, the processor of the gaming system may automatically initiate the play of the bonus game and randomly generate symbols for the play of the game.

In one embodiment, the gaming system uses a random number generator to randomly generate a plurality of symbols for the bonus game from one or more bonus symbol sets as indicated in block 372. In one embodiment, at least one bonus symbol set includes at least one placeholder symbol. In some embodiments, the placeholder symbol is a transparent symbol (e.g., when a placeholder symbol is displayed the gaming system may display underlying reel strip). In one embodiment, at least one bonus symbol set includes at least one placeholder symbol and at least one blank symbol. In such embodiments, the placeholder symbol and the blank symbol function differently, but look the same. In some embodiments, the placeholder symbol and the blank symbol look different and function differently. In an embodiment with a plurality of bonus symbols sets, one or more of the bonus symbol sets includes at least one placeholder symbol. One or more of the bonus symbol sets may include a plurality of placeholder symbols. In some embodiments with a plurality of bonus symbol sets, one of the bonus symbols sets may not have any placeholder symbols. In one embodiment, a placeholder symbol functions differently from a blank symbol because the placeholder symbol is not used to evaluate winning combinations. Rather, in some embodiments, a displayed placeholder symbol represents a placeholder in a symbol display area which can be replaced with a replacement symbol (e.g., an associated pull down symbol). The replacement symbol can take the place of a placeholder symbol (e.g., replace a placeholder symbol) for the purpose of the gaming system evaluating winning symbol combinations.

In one embodiment, the gaming system may cause a first display device to display the plurality of symbols generated as indicated in block 372. In a play of a game using reels, the gaming system may display the generated plurality of symbols in visible symbol display areas of each of the reels as illustrated in block 374. Should the generated plurality of symbols include one or more placeholder symbols, the visible symbol display area for each generated placeholder symbol is transparent, such that no symbol is shown in the symbol display area. The transparent symbol display area indicates to the player that a symbol has not yet been shown for that particular symbol display area in some embodiments. In some embodiments, the placeholder symbol may include some indicator symbol that informs the player that the placeholder symbol is different from a blank symbol.

In one embodiment, the gaming system uses a random number generator to randomly generate one or more replacement symbols from at least one replacement symbol set as indicated in block 376. In some embodiments, the replacement symbol set comprises one or more of the same symbols used for the base game's symbol sets. In some embodiments, the replacement symbol set comprises one or more symbols that are different from the symbols from the base game's symbol sets. In some embodiments, the replacement symbol set comprises at least one wild symbol, at least one scatter symbol, or a combination of both. In some embodiments, the gaming system is configured to generate at least one predetermined symbol from the replacement symbol set. In some embodiments, the gaming system is configured to generate at least one predetermined symbol and randomly generate at least one other symbol from the replacement symbol set.

In some embodiments, the gaming system includes a plurality of replacement symbol sets for a play of a game. In a game with that generates a plurality of replacement symbols, at least two of the plurality of replacement symbols are generated from two different replacement symbol sets, where each of the two different replacement symbols sets includes a different plurality of symbols. In some embodiments, the replacement symbol sets comprise the same symbols used for the base game's symbol sets. In some embodiments, one or more of the plurality of replacement symbol sets comprise the one or more different symbols than symbols used for the base game's symbol sets. In some embodiments, one or more of the plurality of replacement symbol sets comprise a fewer quantity of symbols than the quantity of symbols used for the base game's symbol sets. In some embodiments, the plurality of replacement symbol sets comprise symbols that are all weighted equally for purposes of randomly generating symbols from the plurality of replacement symbols sets. In some embodiments, at least one of the plurality of replacement symbol sets comprises symbols that are weighted differently for purposes of randomly generating symbols from the plurality of replacement symbols sets. In some embodiments, all of the plurality of replacement symbol sets comprise symbols that are weighted differently between different ones of the plurality of replacement symbol sets for purposes of randomly generating symbols from the plurality of replacement symbols sets.

In some embodiments, the replacement symbol sets can be displayed on a video slot machine reel. In some embodiments with one replacement symbol set, the replacement symbol set is displayed on one video slot machine reel. In some embodiments with one replacement symbol set, the replacement symbol set is displayed on a video selector wheel. In embodiments with a plurality of replacement symbols set, the video slot machine reels and the video selector wheels can be used for some or all of the plurality of replacement symbol sets.

In some embodiments with one replacement symbol set, the replacement symbol set is displayed as a series of concealed selections areas that are revealed when the player makes one or more selections of the concealed selection areas. The symbols associated with each of the concealed selection areas (from the replacement symbol set) may be associated before, during, or after the user has made a selection. When symbols are associated with each of the concealed selection areas before the user selection, the gaming system provides an element of skill based on the player's ability to select the best symbols. In some embodiments, the gaming system randomly selects one symbol (from the replacement symbol set) for association with a concealed selection area during or after the user selects the concealed selection area. It should be appreciated that other suitable selector mechanisms can be used to generate and display symbols from the replacement symbol set. In some embodiments with a plurality of replacement symbol sets, the gaming system uses a single video slot machine reel for each of the replacement symbol sets. In some such embodiments, each video slot machine reel displays one generated symbol during a play of the game from each replacement symbol set. In alternative embodiments, each video slot machine reel displays a plurality of generated symbols during a play of the game from each replacement symbol set.

In one embodiment, the gaming system may cause a second display device to display the one or more randomly generated replacement symbols as indicated in block 378. In some embodiments, the one or more randomly generated replacement symbols are displayed alongside one or more predetermined replacement symbols. The predetermined replacement symbols may be a symbol, such as a wild symbol or a scatter symbol, which increases the excitement of the game for the player. In some embodiments, the replacement symbols displayed on the second display device are all randomly generated replacement symbols. It should be appreciated that while blocks 374 and 378 indicate an embodiment in which the generated plurality of symbols in the symbol display areas of the reels are displayed on a first display device and the replacement symbols are displayed on a different display device, in some alternative embodiments both the generated plurality of symbols in the symbol display areas of the reels and the replacement symbols are displayed on the same display device.

The gaming system evaluates, with the processor of the gaming system, the generated symbols in the symbol display areas of the reels for placeholder symbols as indicated in block 380. If the gaming system determines that the generated symbols in the symbol display areas of the reels did not include one or more placeholder symbols, the process of operation 300 moves to block 390 via off page connector F.

On the other hand, if the gaming system determines that the generated symbols in the symbol display areas of the reel included one or more placeholder symbols, the process of operation 300 moves to block 382 via off page connector E. Upon having determined that the generated symbols in the symbol display areas of the reels include one or more placeholder symbols, the gaming system uses a random number generator to randomly determine one of the generated replacement symbols displayed on the second display device for association with one of the placeholder symbols as indicated in block 382. In one embodiment, when a plurality of replacement symbols are displayed on the second display device, each displayed replacement symbol is associated with a weight or a probably of being generated for association with one of the generated placeholder symbols. In one embodiment, displayed replacement symbols are weighted equally, such that the chance for determining one of the displayed replacement symbols for association with one of the generated placeholder symbols is the same as determining one of the other displayed replacement symbols. In another embodiment, the replacement symbol displayed on the second display device are weighted differently, such that there is a greater chance for determining one of the displayed replacement symbols for association with one of the generated placeholder symbols than determining one of the other displayed replacement symbols. The determination of the replacement symbols may be weighted differently to increase the chance that a desirable symbol, such as a wild symbol or a scatter symbol, be determined for association with one of the generated placeholder symbols so as to increase player's chance of obtaining a winning symbol combination and therefore increasing the player's excitement. It should be appreciated that in some embodiments, the weightings assigned to generated and displayed replacement symbols (e.g., for use in randomly determining one of the generated and displayed replacement symbols displayed on the second display device for association with one of the placeholder symbols), may be different from the weightings used to generate the replacement symbols for display on the second display device from the replacement symbol sets. Thus, the gaming system may associated more than one weightings to a replacement symbol for different portions of play if the game in some embodiments.

Upon the determination of a replacement symbol displayed on the second display device for association with one of the generated placeholder symbols, the processor of the gaming system updates the placeholder symbol with the associated randomly determined replacement symbol, as indicated in block 384. As part of the update to such placeholder symbol, the gaming system may use the associated replacement symbol in place of such placeholder symbol when evaluating the displayed symbols for winning symbol combinations. It should be appreciated that in some embodiments, the gaming system may perform such evaluation before any symbols are displayed to the player. In some embodiments, the player must place a predetermined wager amount in a play of the game to obtain use of an associated replacement symbol that replaces a placeholder symbol for obtaining prize amounts based on evaluated winning symbol combinations using associated replacement symbols.

In some embodiments, the gaming system may use one determined replacement symbol for all of the generated placeholder symbols during a play of the game. Thus, one determined replacement symbol may be used more than once during a play of the game. In such embodiments, the gaming system replicates the one determined replacement symbol in the symbol display areas of each associated placeholder symbols.

In some embodiments, one determined replacement symbol may be used only once during a play of the game to replace one generated and displayed placeholder symbol. In one such embodiment, once the one determined replacement symbol is used during a play of the game to replace a generated and displayed placeholder symbol (e.g., the one determined replacement symbol is displayed in the symbol display area of the associated placeholder symbol), the gaming system removes the one determined replacement symbol display from all other areas of the display (or the second display device in certain embodiments).

In some embodiments, as will be discussed below, the gaming system may separately randomly determine a replacement symbol for each generated placeholder symbols during a play of the game. In some embodiments with predetermined replacement symbols, the gaming system may use at least one predetermined replacement symbol for at least one generated placeholder symbol before determining other generated replacement symbols for association with other generated placeholder symbols. For example, if the gaming system included a wild symbol as one of the predetermined replacement symbols, the gaming system may be configured to always use such wild symbol before randomly determining a replacement symbol for one of the generated placeholder symbols in some embodiments.

In one embodiment, the gaming system may cause the first display device to display the symbol of the associated randomly determined replacement symbol in the symbol display area of the placeholder symbol as indicated in block 386. In some embodiments, the symbol of the associated randomly determined replacement symbol displayed in the symbol display area of the placeholder symbol may have an substantially identical appearance and size to the associated randomly determined replacement symbol. In some embodiments, the symbol (e.g., the replicated associated randomly determined replacement symbol) of the associated randomly determined replacement symbol displayed in the symbol display areas of the placeholder symbol has different appearance and/or size than the associated randomly determined replacement symbol, but is still recognizable to the player as the same associated randomly determined replacement symbol. In some embodiments, the symbol of the associated randomly determined replacement symbol is automatically displayed in the symbol display area of the placeholder symbol. In some embodiments, the symbol of the associated randomly determined replacement symbol is displayed in the symbol display area only after the gaming system received an input from an input device. In one embodiment, the player may push a button to cause the gaming system to display the replacement symbol in the symbol display area. In some embodiments, the player may drag a highlighted replacement symbol to the symbol display area with an input device of the gaming system (e.g., a touch screen or a mouse). Waiting for an input from an input device to display the symbol of the associated randomly determined replacement symbol in the symbol display area of the placeholder symbol increases player involvement in the play of the game in some embodiments. In some embodiments, a graphic animation is displayed pulling or moving the symbol of the associated randomly determined replacement symbol from its symbol display area in the second display device to the symbol display area of the associated placeholder symbol in the first displace device. The graphic animation highlights to the player which of the displayed replacement symbols in the second display device has been determined for the placeholder symbol in the first display device. The graphic animation also provides the player with a dramatic display of moving the determined replacement symbol into the symbol display area of the placeholder symbol. In some embodiments, the graphic animation automatically runs. In some embodiments, the graphic animation runs only after the gaming system received an input from an input device in order to increase player involvement.

The gaming system evaluates, with the processor of the gaming system, the remaining generated symbols in the symbol display areas of the reels for additional placeholder symbols as indicated in block 388. If the gaming system determined that the generated symbols in the symbol display areas of the reels do include one or more additional placeholder symbols that have not been associated with or replaced with replacement symbols, the process of operation 300 moves back to block 382. On the other hand, if the gaming system determined that the remaining generated symbols in the symbol display areas of the reels do not include any additional placeholder symbols, the process of operation 300 moves to block 390.

In one embodiment as shown in block 390, the gaming system evaluates the generated symbols in the symbol display areas of the reels, with any and all placeholder symbols updated with the replacement symbols of the associated replacement symbols, across active pay lines for winning symbol combinations. In some embodiments, the gaming system evaluates the winning symbol combinations based on the pay lines wagered upon by a player in the base game. The gaming system may evaluate the player selected pay lines, gaming system assigned pay lines, or pay lines assigned as active in some other manner for the play of the game. It should be appreciated that in some embodiments, no wager is required to activate a pay line in some plays of the game. In one embodiment using reels, the gaming system determines an award amount based on winning symbol combinations formed across the reels on active pay lines, including replacement symbols that replace placeholder symbols. For example, if a pay table associated with the gaming system indicated that at least three of the same bar symbols is a winning symbol combination and awards a predetermined payout, the gaming system would evaluate the generated plurality of symbols for bar symbols. If the gaming system generated at least three bar symbols on adjacent reels and along an active pay line, the gaming system may determine that the three bar symbols is a winning symbol combination based on the predetermined pay table. It should be appreciated that a pay table may include any suitable number of winning symbol combinations and payouts. In one embodiment, a pay table may indicate that as few as one symbol may be associated with a payout. Alternatively, two or more symbols may be used to form winning symbol combinations that result in a payout.

In some embodiments, the player's ability to use replacement symbols to form winning symbol combinations may be based on a player's wager in a base game (or in a bonus game). For example, the gaming system may replace placeholder symbols with determined replacement symbols. However, if the player did not wager a threshold amount during the base game, the gaming system may ignore the replacement symbols on the reels for purposes of determining winning symbol combinations. That is, the gaming system may evaluate the placeholder symbols instead of the associated replacement symbols for purposes of determining winning symbol combinations. The gaming system may inform a player that the player may have won a larger award during a play of the game with the replacement symbols if the player had wagered a predetermined amount for a play of the game.

In block 392, the gaming system determines, with the processor, a payout amount for the bonus game based on the evaluated winning symbol combinations across wagered pay lines. As illustrated in block 394, the gaming system may update, with the processor, the player's gaming credit balance in accordance with any award amount for the bonus game and may proceed to off page connector D and return to block 362 in FIG. 3B.

As indicated in block 362, the gaming system may receive a signal to end game play or "cash out" via an input device of the gaming system. In such a situation, as illustrated in block 364, the gaming system dispenses a value to the player through a value dispenser based on the player's gaming credit balance and operation 300 ends.

On the other hand, if the gaming system processor has not received a signal to end game play via the player input device, the process of operation 300 returns to block 315 via off page connector B. The gaming system may receive, via a player input device, a wager for another play of the game and continue operation 300 from block 315. However, in one embodiment, the wager may not be accepted if the player has fewer credits than the player's selected wager amount as shown in block 315.

FIGS. 4A and 4C-4H illustrate screen shots of one embodiment of a gaming system having placeholder symbols and pull down symbols.

Figure 4A:
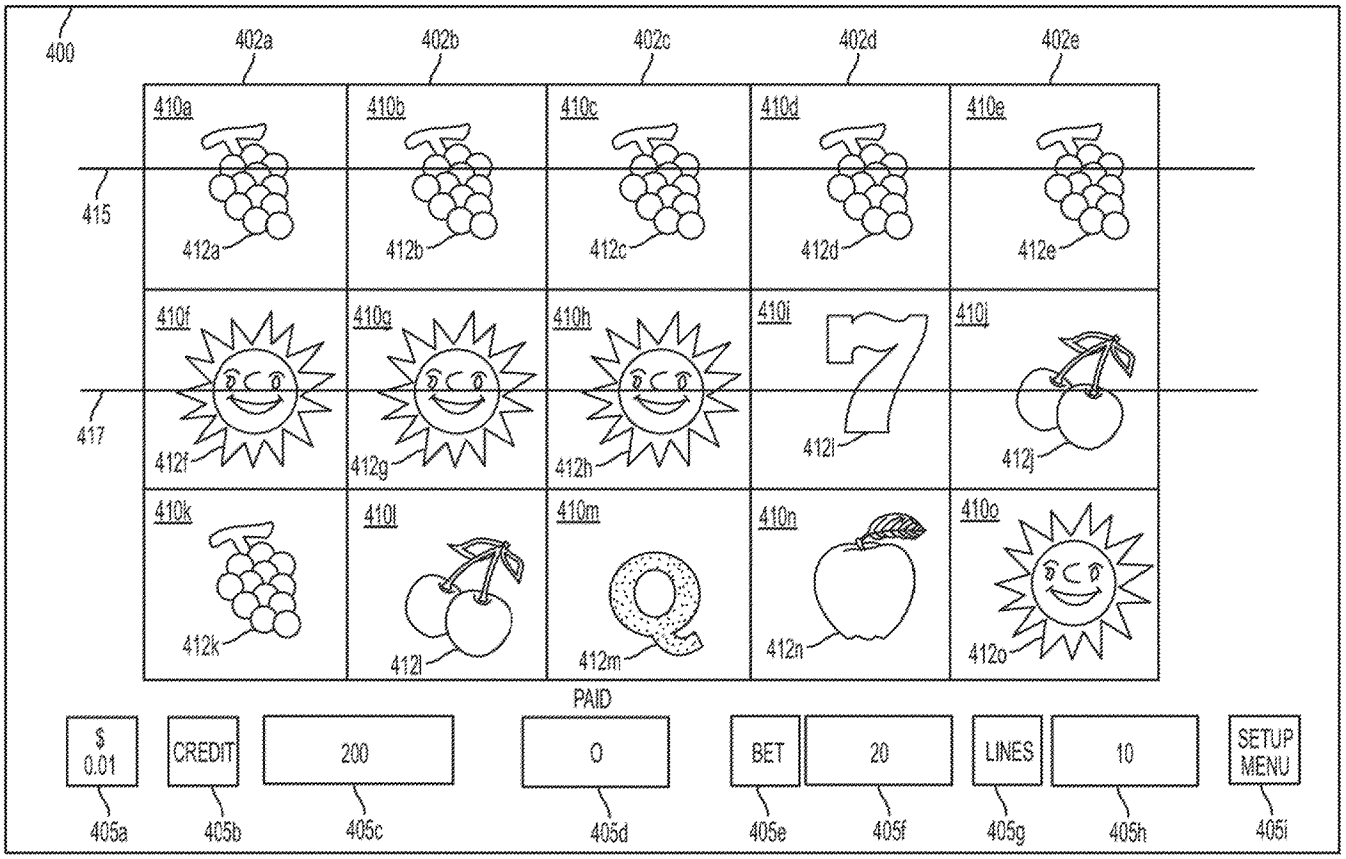
FIGS. 4A, 4B, 4C, 4D, 4E, 4F, 4G, and 4H illustrate one embodiment of a gaming system including placeholder symbols and pull down symbols.

FIG. 4A illustrates one embodiment of a display device 400 that a gaming device may display on a display device of the gaming system. In one embodiment, display device 400 may be the first display device 120 of gaming device 100 illustrated in FIG. 1. However, any other suitable display device may be used. The display device 400 displays a set of a plurality of virtual video slot machine reels 402*a*, 402*b*, 402*c*, 402*d*, and 402*e* as illustrated in FIG. 4A for a primary or base game. As also illustrated in FIG. 4A, the reels 402*a*-402*e* are displayed substantially side by side. It should be appreciated that reels 402*a*-402*e* can be displayed with any suitable amount of separation or no separation. It should be appreciated that the game shown in display device 400 is merely representative and may have more or fewer game elements (e.g., reels, symbol display areas, symbols, etc.) shown in the display device 400. It should also be appreciated that other games may be used for the primary or base game.

The plurality of reels 402*a*-402*e* are each associated with a set of symbols, where each set of symbols includes a plurality of symbols. Each set of symbols can be associated with the same or a different plurality of symbols. The sets of symbols may include numbers, letters, geometric figures, symbols, images, character, blank symbols (e.g., the absence of symbols), animations, transparent symbols (e.g., symbols that permits underlying symbols to be visible), or any other suitable graphical depiction. The symbols in the sets of symbols may include pay symbols and special or designated symbols. In some embodiments, the sets of symbols may include placeholder symbols. In one embodiment, at least one predetermined symbol is a triggering symbol for a bonus game. In one embodiment, at least one triggering symbol must be generated on the reels during a play of a game to trigger the bonus game. In some embodiments, a plurality of triggering symbols must be generated on the reels during a play of a game to trigger the bonus game. In one embodiment, any one of the symbols in the sets of symbols can be designated as the predetermined triggering symbol. The triggering symbol may be associated with one function (e.g., triggering a bonus game), but may alternatively be associated with a plurality of different game functions. The triggering symbol may be a scatter symbol in some embodiments.

Returning now to FIG. 4A, the display device 400 depicts a plurality of symbol display areas (also referred to herein as symbol display positions) 410*a*, 410*b*, 410*c*, 410*d*, 410*e*, 410*f*, 410*g*, 410*h*, 410*i*, 410*j*, 410*k*, 410*l*, 410*m*, 410*n*, and 410*o*. These plurality of symbol display areas can be associated in a manner that provides the appearance of game reels. It should also be appreciated that the symbol display areas may not be associated with game reels in some embodiments. As illustrated in FIG. 4A, symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, 410*o* are associated in a manner that provides the appearance of a set of five slot machine game reels. In one embodiment, the plurality of symbol display areas that provide the appearance of five game reels may be arranged in a manner that visibly shows three symbol positions of each of the five game reels. For example, the symbol display areas 410*a*-4010 are each associated with positions on reels 402*a*-402*e*, respectively. As shown in FIG. 4A, symbol display areas 410*a*, 410*f*, and 410*k* are associated with reel 402*a*; symbol display areas 410*b*, 410*g*, and 410*l* are associated with reel 402*b*; symbol display areas 410*c*, 410*h*, and 410*m* are associated with reel 402*c*; and symbol display areas 410*d*, 410*i*, and 410*n* are associated with reel 402*d*; and symbol display areas 410*e*, 410*j*, and 410*o* are associated with reel 402*e*. The arrangement illustrated in the embodiment of FIG. 4A thus creates a visible display area of the reels 402*a*-402*e* comprising three visible symbol positions for each reel. When viewed together, reels 402*a*-402*e* appear like a 3-row by 5-column reel array in display 400. In other embodiments, smaller or larger visible areas of the reels can be displayed. That is, the reels 402*a*-402*e* may show fewer or a larger number of visible symbol display areas. While symbol display areas are illustrated with defined boxes, it should be appreciated that in some embodiments, the defined boxes are not visible to the player. It should also be appreciated that in some embodiments, the symbol display areas are other shapes or not defined shapes and may not be associated with reels.

Each reel 402*a*-402*e* may display a plurality of symbols that the gaming system generates from the sets of symbols in their respective symbol display areas as illustrated in FIG. 4A. In one embodiment, the reels may be shown spinning in one direction to simulate slot machine reels. However, it should be appreciated that the reels may be shown spinning in any suitable direction. The reels may also be shown spinning in different directions in some embodiments.

Display device 400 also includes several information areas and buttons 405*a*-405*i*. These information areas and buttons 405*a*-405*i* are illustrated in a particular arrangement, but may be arranged in any suitable manner in different embodiments. In some embodiments, display device 400 may include more or fewer display areas and buttons 405*a*-405*i* than illustrated. Information area 405*a* illustrates an example value of one credit for the game displayed in display device 400. Information areas 405*b* and 405*c* illustrate an example of the amount of the player's available credits. Information area 405*d* illustrates the amount of credits a player has won. Because FIG. 4A illustrates the start of a play of a game, the information area 405*d* shows zero credits have been won. Button 405*e* illustrates a software button that the player can select to place a bet or wager. It should be appreciated that the functionality of button 405*e* may also be replicated or replaced with a hardware button on the gaming device 100. Information area 405*f* illustrates that the player has selected to wager 200 credits. Button 405*g* illustrates a software button that the player can select to determine how many pay lines to wager on. It should be appreciated that the functionality of button 405*g* may also be replicated or replaced with a hardware button on the gaming device 100. Information area 405*h* illustrates that the player selected to wager on 10 pay lines. Button 405*i* illustrates a software button that the player can select to obtain information about the game, change certain aspects of the game, obtain help, place an order, etc.

To start a gaming session, a player provides the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game and to also place wagers on a play of the game. The gaming system may provide a visual indication of the player's credit balance to the player as discussed above in information area 405*c*.

To initiate a play of a game, the player activates or presses one or more appropriate buttons on the gaming system to deduct credits necessary to play the game and to identify the player's wager. Along with receiving the player's wager, the gaming system may receive pay line selections or other game functions the player wishes to activate in exchange for the wager. The player may also actuate a game start button, a spin button, or a lever. The gaming system may deduct the appropriate credits from the player's credit balance after the wager or at any suitable time.

Upon receipt of the player's wager and activation of the game start button, the gaming system may show a display of spinning reels for each of the reels 402*a*-402*e*. The spinning may appear to occur in a vertical top to bottom direction or in a vertical bottom to top direction (not shown), or in a combination of vertical directions (not shown). In one embodiment, the gaming system randomly generates symbols from the associated sets of symbols for reels 402*a*-402*e*, respectively. As noted above, the gaming system may rely on random generation performed by a pseudo RNG, a true RNG, or hardware RNG specifically designed for gaming systems. In one embodiment, the gaming system may also update the player's credit meter (information area 405*c*) to reflect the player's available credit balance. As shown in FIG. 4A, the player's credit meter (information area 405*c*) was decremented by 200 credits from 400 to 200 to reflect the 200 credit wager the player placed for the play of the game.

The gaming system displays the generated symbols 412*a*-412*o* in symbol display areas 410*a*-410*o* as illustrated in FIG. 4A. Symbols 412*a*-412*o* displayed on reels 402*a*-402*e* illustrate the randomly generated symbols from the set of symbols after the reels have stopped spinning. As illustrated in FIG. 4A, the gaming system randomly generated and displayed symbols 412*a*, 412*f*, and 412*k* in symbol display areas 410*a*, 410*f*, and 410*k* for reel 402*a*. The gaming system also randomly generated and displayed symbols 412*b*, 412*g*, and 412*l* in symbol display areas 410*b*, 410*g*, and 410*l* for reel 402*b*; symbols 412*c*, 412*h*, and 412*m* in symbol display areas 410*c*, 410*h*, and 410*m* for reel 402*c*; symbols 412*d*, 412*i*, and 412*n* in symbol display area 410*d*, 410*i*, and 410*n* for reel 402*d*; symbols 412*e*, 412*j*, and 412*o* in symbol display area 410*e*, 410*j*, and 410*o* for reel 402*e*.

As illustrated in FIG. 4A, the gaming system generated and displayed Grape symbols (412*a*, 412*b*, 412*c*, 412*d*, 412*e*, 412*k*), Sun symbols (4120*f*, 412*g*, 412*h*, 412*o*), a Seven symbol (412*i*), Cherry symbols (412*j*, 412*l*), a Queen symbol (412*m*), and an Apple symbol (412*n*) in the display device 400. It should be appreciated that the displayed symbol combinations are merely for explanatory purposes and the gaming system may randomly generate any suitable combination of symbols based on defined symbol sets associated with the reels 402*a*-402*e*.

FIG. 4A further illustrates one embodiment of a gaming system executing an evaluation of the generated symbols on reels 402*a*-402*e* for winning symbol combinations. As noted above, the player may have wagered on one or more pay lines (such as 10 pay lines shown in information area 405*h*). In one embodiment, at least the active (wagered on pay lines) are evaluated for winning symbol combinations. Any suitable number of pay lines may be used to evaluate winning symbol combinations.

In the embodiment illustrated in FIG. 4A, the gaming system evaluated the generated symbol combinations for winning symbol combinations. In FIG. 4A, the gaming system determined that a winning symbol combination is displayed across one wagered pay line. The pay line spans across a horizontal direction of symbol display areas including symbol display areas 410*a*, 410*b*, 410*c*, 410*d*, and 410*e*. In this embodiment, the gaming system displayed five Grape symbols along a horizontal pay line on which the player had placed a wager. The gaming system determined the five Grape symbols form a winning symbol combination based on a pay table associated with the gaming system (such as the base game pay table in FIG. 4B). The winning pay line is illustrated as pay line 445 in FIG. 4A across the row of reels 402*a*-402*e*.

Figure 4B:
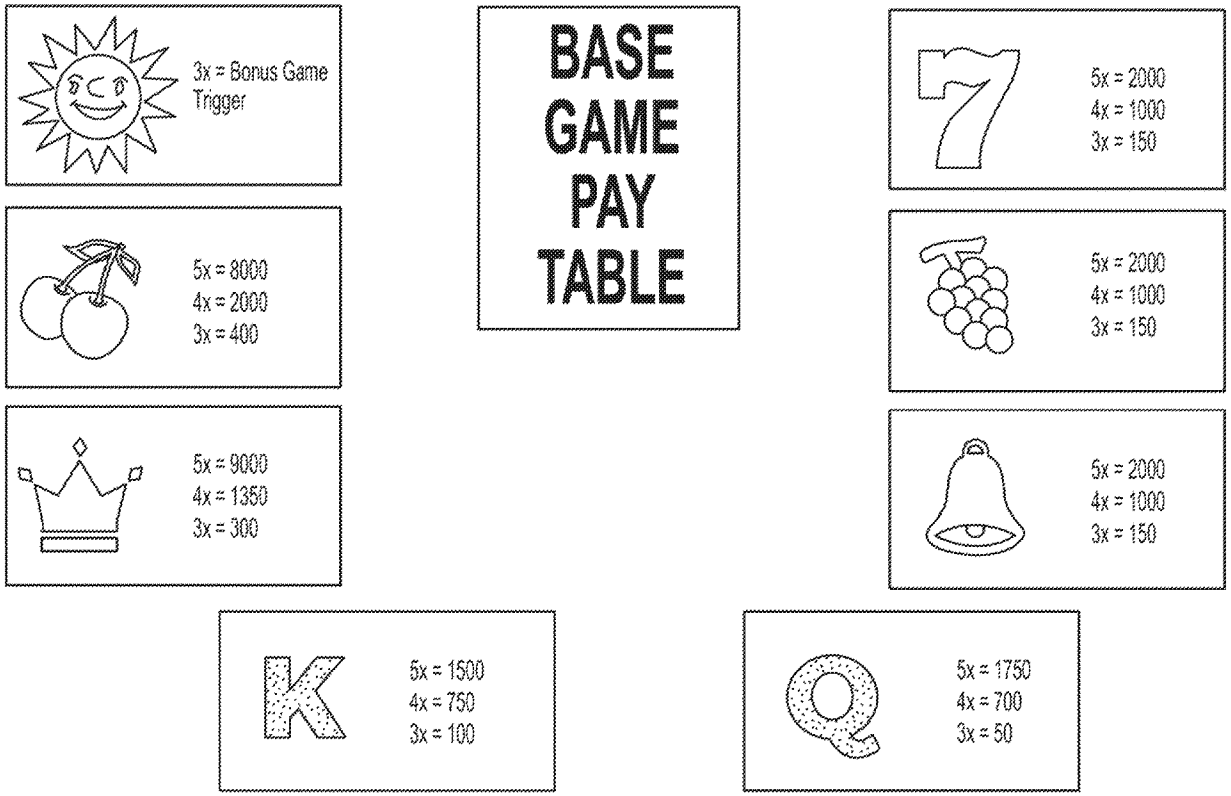

As noted at block 355 of FIG. 3B, in one embodiment, the gaming system may also evaluate the generated symbols on reels 402*a*-402*e* for triggering symbols that trigger a bonus game. As illustrated in FIG. 4B, a bonus game is triggered when at least three Sun symbols are generated along a pay line. Returning to FIG. 4A, the gaming system determined that three Sun symbols (412*f*, 412*g*, and 412*h*) were generated for the play of the game along wagered pay line 447. In the illustrated embodiment, the Sun symbol was designated as the bonus game triggering symbol. It should be appreciated that any other suitable symbol could be designed as the bonus game triggering symbol. In some embodiments, more than one different symbol can be designated as a bonus triggering symbol. In some embodiments, a combination of different triggering symbols along a pay line may be required to trigger a bonus game. In some embodiments, a predetermined quantity of scatter symbols can be used as a bonus game trigger. In some embodiments, the gaming system may highlight the Sun symbols in some manner (not shown) so that player understands that the player won a bonus game or other game features. It should be appreciated that the gaming system may highlight the bonus triggering symbol in any suitable manner. It should also be appreciated that the gaming system may not highlight the bonus triggering symbols in some embodiments, as is illustrated in FIG. 4A.

In some embodiments, the gaming system may be required to generate more than one bonus triggering symbol to activate a bonus game (as shown in pay table of FIG. 4B). In other embodiments, the features available in the bonus game may depend on the quantity of bonus triggering symbols that the game system generates. In one embodiment, at least one bonus trigging symbol must be generated in the far most reel 402*a* (in any symbol display area) to trigger the bonus game. That is, if the at least one bonus triggering symbol is generated in reels 402*b*, 402*c*, 402*d*, or 402*e*, the gaming system may not activate the bonus game. However, in other embodiments, the bonus triggering symbol may appear on any reel in any symbol display area to trigger the bonus game. In some embodiments, the gaming system may evaluate the bonus triggering symbols from a left to right direction along the reels. In some embodiments, the gaming system may evaluate the bonus triggering symbols from a right to left direction along the reels.

Returning to FIG. 4A, the gaming system determined that three triggering symbols (the Sun symbols 420*f*, 420*g*, and 420*h*) were generated on adjacent reels 402*a*, 402*b*, and 402*c* in symbol display areas 410*f*, 410*g*, and 410*h*. Based on the generated bonus triggering symbol on such adjacent reels along wagered pay line 447, the gaming system activates a bonus game.

Figure 4C:
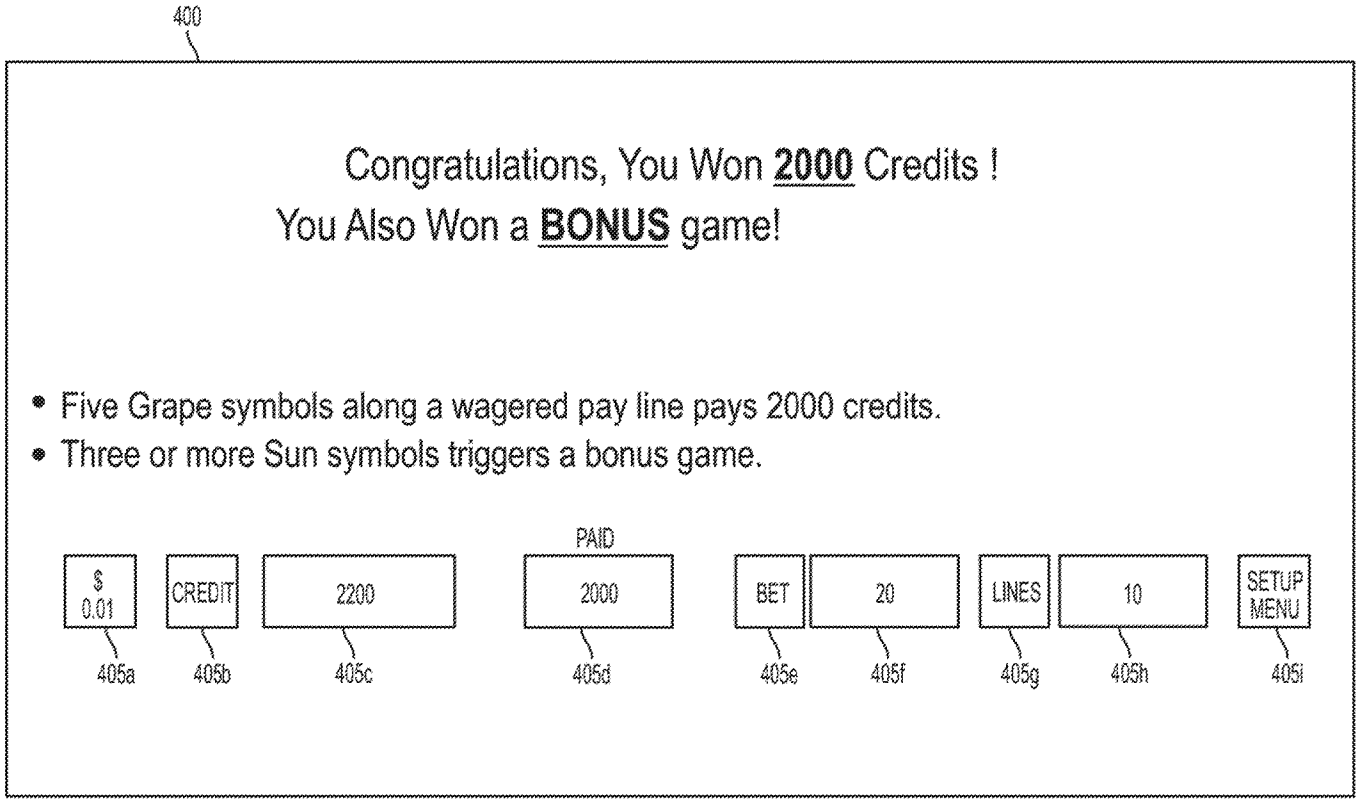

Turning now to FIG. 4C, the gaming system in one embodiment provides the player with information regarding all of the awards for the play of the base game. In this embodiment, the gaming system alerts the player that the player won 2000 credits and a bonus game. In some embodiments, the gaming system may break down how the player won the credits and free spin bonus game. For example, the gaming system may describe that the five Grape symbols along a wagered pay line pays 2000 credits (e.g., based on the pay table illustrated in FIG. 4B). The gaming system may also indicate that Sun symbols trigger the bonus game. It should also be appreciated that the awards illustrated in FIG. 4B and FIG. 4C are merely illustrative and could be adjusted to include any suitable awards and different credit amounts.

As illustrated in FIG. 4C, the gaming system awards the appropriate number of credits to the player and updates the player's win meter (shown in information area 405*d*) to reflect the player's winnings during the play of the game. In one embodiment, the gaming system may also update the player's credit meter (information area 405*c*) to reflect the player's available credit balance.

If the player did not win a bonus game, the player may continue the gaming session by playing another game. That is, the player may place another wager and start a new play of the game as noted above. However, continued game play is dependent of the number of credits remaining in the player's credit balance. The player may also choose to cash out. In such an instance, the gaming system provides the player a value based on the player's credit balance using any of the value items discussed above (bills, coins, vouchers, etc.).

Figure 4D:
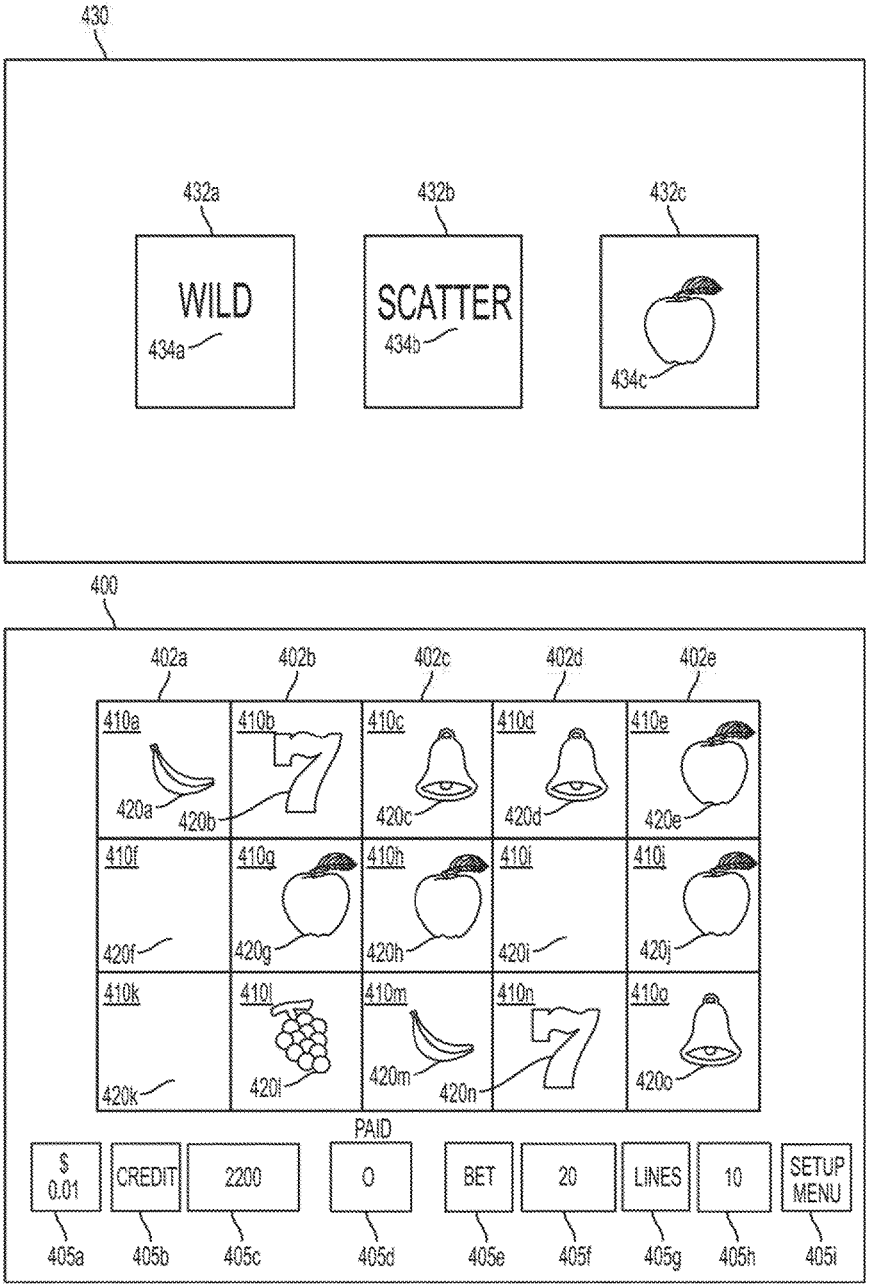

FIG. 4D illustrates one embodiment where the player won a bonus game. In one embodiment, the request to initiate the play of the bonus game may be received from a player via a player input device in communication with the gaming system. For example, the player may press a spin button on the gaming system to start the play of the bonus game. In an alternative embodiment, the processor of the gaming system may automatically initiate the play of the bonus game.

In one embodiment, the gaming system uses a random number generator to randomly generate a plurality of symbols 420*a*-420*o* from at least one bonus symbol set for the bonus game. In some embodiments, as illustrated in FIG. 4D, the gaming system uses a random number generator to randomly generate a plurality of symbols 420*a*-420*o* from a plurality of bonus symbol sets, wherein each reel 402*a*-402*e* is associated with its own bonus symbol set. At least one bonus symbol set comprises at least one placeholder symbol. In some embodiments, a plurality of bonus symbol sets comprise one or more placeholder symbols. In some embodiments, each bonus symbol set comprises at least one placeholder symbol. The gaming system displays the generated symbols 420*a*-420*o* from the associated bonus symbol sets in symbol display areas 410*a*-410*o* of the display device 400 as illustrated in FIG. 4D. Symbols 420*a*-420*o* displayed on reels 402*a*-402*e* illustrate the randomly generated symbols from the bonus symbol sets after the reels have stopped spinning. As illustrated in FIG. 4D, the gaming system randomly generated and displayed symbols 420*a*, 420*f*, and 420*k* in symbol display areas 410*a*, 410*f*, and 410*k* for reel 402*a*. The gaming system also randomly generated and displayed symbols 420*b*, 420*g*, and 420*l* in symbol display areas 410*b*, 410*g*, and 410*l* for reel 402*b*; symbols 420*c*, 420*h*, and 420*m* in symbol display areas 410*c*, 410*h*, and 410*m* for reel 402*c*; symbols 420*d*, 420*i*, and 420*n* in symbol display area 410*d*, 410*i*, and 410*n* for reel 402*d*; symbols 420*e*, 420*j*, and 420*o* in symbol display area 410*e*, 410*j*, and 410*o* for reel 402*e*.

As illustrated in FIG. 4D, the gaming system generated and displayed Banana symbols (420*a*, 420*m*), Seven symbols (420*b*, 420*n*), Apple symbols (420*e*, 420*g*, 420*h*, and 420*j*), a Grape symbol (420*l*), Bell symbols (420*c*, 420*d*, and 420*o*), and Placeholder symbols (420*f*, 420*i*, 420*k*) on the display device 400. It should be appreciated that the displayed symbol combinations are merely for explanatory purposes and the gaming system may randomly generate any suitable combination of symbols based on defined bonus symbol sets associated with the reels 402*a*-402*e*. In some embodiments, one or more of the symbols 420*f*, 420*i*, and 420*k* may be Blank symbols rather than Placeholder symbols. In some such embodiments, the gaming system may alert the player of a difference between a Blank symbol and a Placeholder symbol. For example, a Placeholder symbol may be distinguished from a Blank symbol with shading, a different color, a border around the symbol display area, or some other symbol. In other embodiments, the gaming system may not provide any indication of a different between a Placeholder symbol and a Blank symbol to increase a player's anticipation of obtaining a Placeholder symbol.

In one embodiment, the gaming system randomly generates one or more pull down symbols from at least one pull down symbol set. The pull down symbol set may comprise the same symbols from the base game's symbol set or the pull down symbol set may comprise one or more symbols that are different from the symbols from the base game's symbol set. The pull down symbol set may comprise at least one wild symbol, at least one scatter symbol, or at least one of both symbols. In one embodiment, the gaming system displays the randomly generated one or more pull down symbols on a second display device 430. In one embodiment, the second display device 430 may be the second display device 130 of gaming device 100 illustrated in FIG. 1. In some embodiments, the randomly generated one or more pull down symbols are generated and displayed on the same display device as the reels 402*a*-402*e*. In one embodiment, the gaming system may also display one or more predetermined pull down symbols with the randomly determined pull down symbols. The predetermined pull down symbols may be designated prior to or during a play of a game. The predetermined pull down symbols can be selected from the pull down symbol set. The predetermined pull down symbols can be selected independent of the pull down symbol set. In one embodiment, the predetermined pull down symbols can be selected from a different pull down symbol set. In some embodiments, a remote gaming server supplies one or more predetermined pull down symbols to the gaming system. In some embodiments, the predetermined pull down symbols remain constant across a plurality of plays of a game.

Returning now to FIG. 4D, the second display device 430 depicts a plurality of pull down symbol display areas 432*a*-432*c*. The gaming system displays two predetermined pull down symbols 434*a* and 434*b* and one randomly generated pull down symbol 434*c* in the pull down symbol display areas 432-432*c*. It should be appreciated that the quantity of predetermined pull down symbols and the quantity of randomly generated pull down symbols displayed on the second display device 430 are merely for explanatory purposes and the gaming system may display any number of predetermined pull down symbols and any number of randomly generated pull down symbols, along with a corresponding number of pull down display areas in the second display device.

As illustrated in FIG. 4D, the gaming system displayed Wild symbol 434*a* and Scatter symbol 434*b* as the predetermined pull down symbols and an Apple symbol 434*c* as the randomly generated pull down symbol. It should be appreciated that the displayed symbol combinations are merely for explanatory purposes and the gaming system may include any suitable predetermined pull down symbols and/or generate any suitable combination of randomly determined pull down symbols from pull down symbol sets.

FIG. 4D further illustrates one embodiment of the bonus game of a gaming system executing an evaluation of the generated symbols 420*a*-420*o* in the symbol display areas 410*a*-410*o* for placeholder symbols. In FIG. 4D, the gaming system determined that the generated symbols include a placeholder symbol 420*f* in symbol display area 410*f*.

In one embodiment, upon the gaming system having determined that the generated symbols 420*a*-420*o* in the symbol display areas 410*a*-410*o* include a placeholder symbol 420*f* in symbol display area 410*f*, the gaming system randomly determines one of the pull down symbols from the set of pull down symbols 434*a*-434*c* displayed on the second display device 430 for association with the placeholder symbol 420*f*. In one embodiment, the pull down symbols 434*a*-434*c* are weighted differently, such that there is a greater chance for determining the Wild pull down symbol 434*a* or the Scatter pull down symbol 434*b* than determining the Apple pull down symbol 434*c*. The determination of the pull down symbol may be weighted differently to increase the chance that the more desirable Wild pull down symbol 434*a* or Scatter pull down symbol 434*b* be determined as associated with the Placeholder symbol 420*f* so as to increase player excitement. It should be appreciated that one or more of the displayed the pull down symbols 434*a*-434*c* can be weighted equally in some embodiments for purposes of random determination for association with a Placeholder symbol. In some embodiments, the pull down symbols 434*a*-434*c* can all be weighted equally for purposes of random determination for association with a Placeholder symbol.

In one embodiment, the gaming system randomly determined the pull down Apple symbol 434*c*. Upon randomly determining the pull down Apple symbol 434*c*, the processor of the gaming system updates an association between Placeholder symbol 420*f* with the Apple symbol 434*c* in memory of the gaming system. The Apple symbol 434*c* is thereafter used as the symbol in symbol display area 410*f* when determining the winning symbol combinations during the play of the game. In some embodiments, the gaming system highlights the randomly determined pull down symbol to identify to the player that a particular pull down symbol was determined.

Figure 4E:
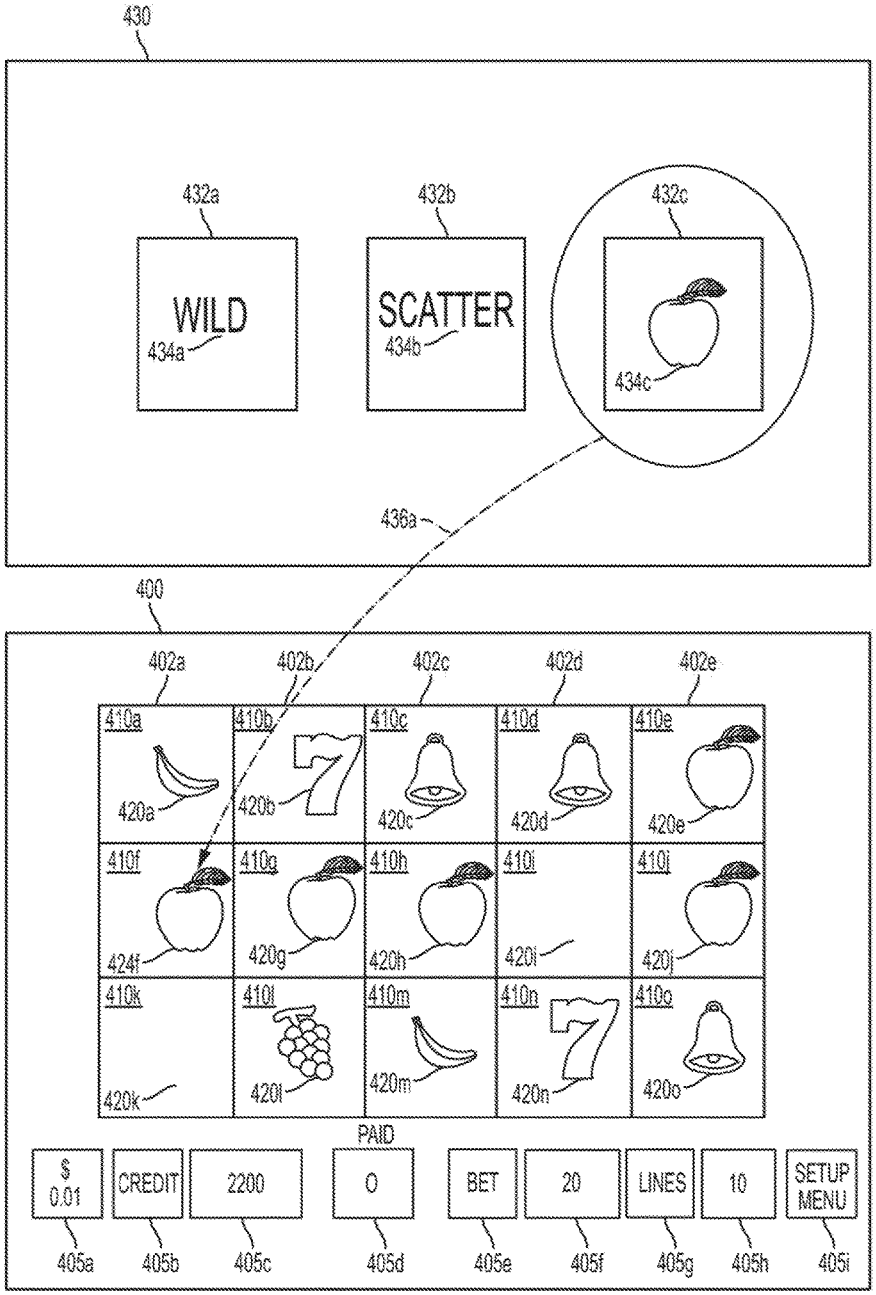

As illustrated in FIG. 4E, the gaming system displays the Apple symbol 424*f* in the symbol display area 410*f*. In one embodiment, when the gaming system displays Apple symbol 424*f* in the symbol display area 410*f* to replace the Placeholder symbol 420*f*, the Apple symbol 424*f* may have an identical appearance and size to Apple symbol 434*c*. In alternative embodiments, the Apple symbol 424*f* may have a different appearance and/or size than the Apple symbol 434*c*, but is still recognizable to the player as the same pull down symbol. In one embodiment, the request to display the Apple symbol 424*f* of the associated randomly determined pull down symbol 434*c* in the symbol display area 410*f* may be received from a player via a player input device in communication with the gaming system. For example, the player may press a spin button or a move button on the gaming system to cause the Apple symbol 434*c* to be moved from the symbol display area 432*c* to symbol display area 424*f*. Waiting for an input from an input device to display the Apple symbol 424*f* in the symbol display area 410*f* increases player involvement in the game. In an alternative embodiment, the processor of the gaming system may automatically display the Apple symbol 424*f* in the symbol display area 410*f*. Any suitable animation may be used to illustrate the movement of the Apple symbol 434*c* to the symbol display area 410*f*.

In one embodiment, the gaming system displays a graphic animation pulling or moving the Apple symbol 434*c* along phantom line 436*a* as illustrated in FIG. 4E, from pull down symbol display area 432*c* in the second display device 430 to the symbol display area 410*f* in the display device 400. The graphic animation highlights to the player which of the displayed pull down symbols in the second display device has been determined to replace the placeholder symbol 420*f* The graphic animation also provides the player with a dramatic display of moving the Apple symbol 434*c* into the symbol display area 420*f* In some embodiments, the graphic animation begins automatically. In some embodiments, the graphic animation begins after the gaming system received an input from an input device in order to increase player involvement in the play of the game.

In one embodiment illustrated in FIG. 4E, the gaming system evaluated the remaining generated symbols 420*a*-420*o* in the symbol display areas 410*a*-410*o* for additional Placeholder symbols. In FIG. 4E, the gaming system determined that the remaining generated symbols 420*a*-420*o* include an additional placeholder symbol 420*k* in symbol display area 410*k*.

In one embodiment, upon the gaming system having determined that the remaining generated symbols 420*a*-420*o* in the symbol display areas 410*a*-410*o* include a Placeholder symbol 420*k* in symbol display area 410*k*, the gaming system randomly determines one of the pull down symbols from the set of pull down symbols 434*a*-434*c* displayed on the second display device 430 for association with the placeholder symbol 420*k*. As noted above, the pull down symbols 434*a*-434*c* can be weighted the same or differently for purposes of randomly determining one of such pull down symbols 434*a*-434*c* to replace the Placeholder symbol 420*k*. In some embodiments, the pull down symbols 434*a*-434*c* are weighted differently from the weighting used to generate the replacement Apple symbol 424*k* in symbol display area 410*k*.

In one embodiment, the gaming system randomly determined the pull down Apple symbol 434*c* as a replacement symbol. Upon randomly determining the pull down Apple symbol 434*c*, the processor of the gaming system updates an association of the Placeholder symbol 420*k* with the Apple symbol 434*c*. The Apple symbol 434*c* is used as the symbol in symbol display area 410*k* when determining the winning symbol combinations during the play of the game. In some embodiments, the gaming system highlights the randomly determined pull down symbol to identify to the player that a particular pull down symbol was determined to replace a placeholder symbol.

Figure 4F:
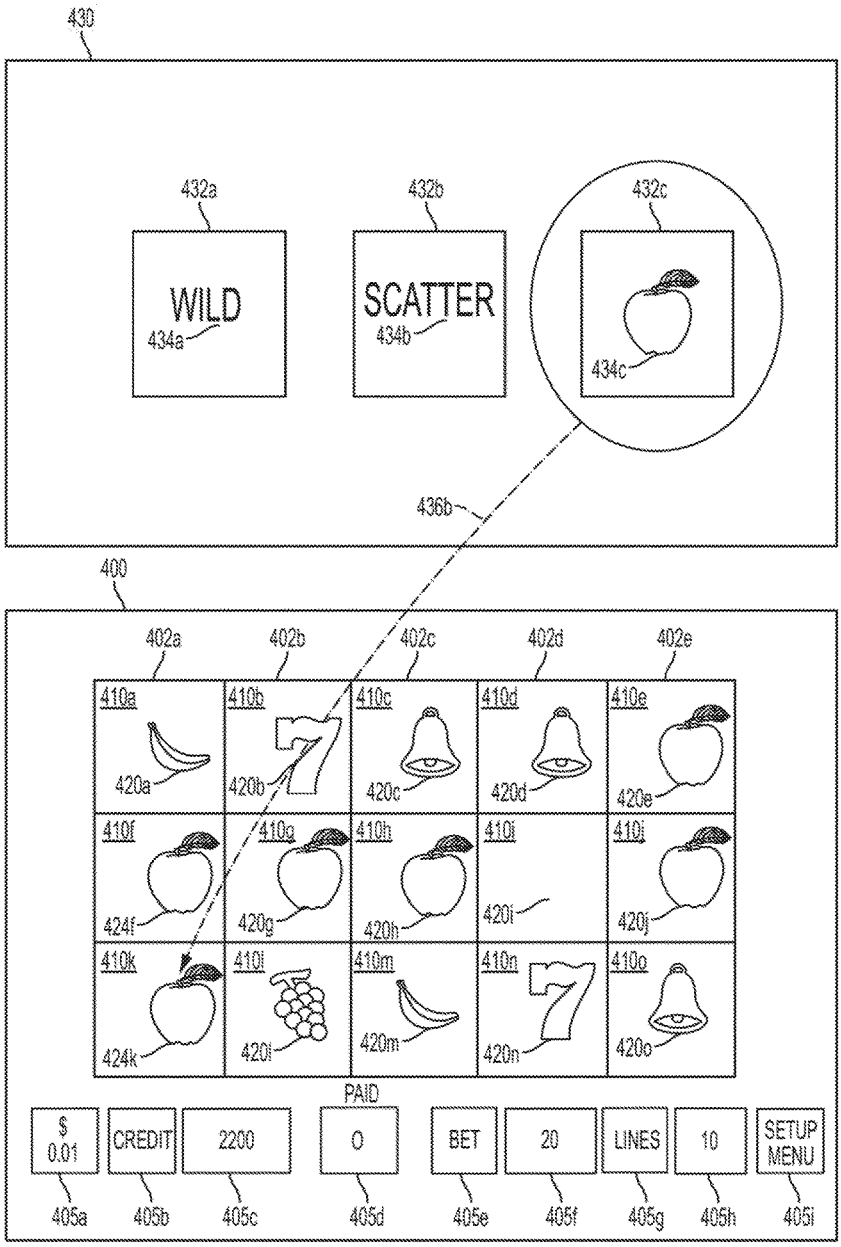

As illustrated in FIG. 4F, the gaming system displays the Apple symbol 424*k* in the symbol display area 410*k*. In one embodiment, when the gaming system displays Apple symbol 424*k* in the symbol display area 410*k* to replace the Placeholder symbol 420*k*, the Apple symbol 424*k* may have an identical appearance and size to Apple symbol 434*c*. In alternative embodiments, the Apple symbol 424*k* may have a different appearance and/or size than Apple symbol 434*c*, but is still recognizable to the player as the same pull down symbol. In one embodiment, the request to display the Apple symbol 424*k* in the symbol display area 410*k* may be received from a player via a player input device in communication with the gaming system. For example, the player may press a spin button or a move button on the gaming system to cause the Apple symbol 434*c* to be moved from the symbol display area 432*c* to the symbol display area 424*k*. Waiting for an input from the input device to display the Apple symbol 424*k* in the symbol display area 410*k* increases player involvement in the game. In an alternative embodiment, the processor of the gaming system may automatically display the Apple symbol 424*k* in the symbol display area 410*k*. Any suitable animation may be used to illustrate the movement of the Apple symbol 434*c* to the symbol display area 410*f*.

In one embodiment, the gaming system displays a graphic animation pulling or moving the Apple symbol 434*c*, along phantom line 436*b* as illustrated in FIG. 4F, from pull down symbol display area 432*c* in the second display device 430 to the symbol display area 410*k* in the display device 400. In some embodiments, the graphic animation begins automatically. In some embodiments, the graphic animation begins after the gaming system received an input from the input device in order to increase player involvement.

In one embodiment illustrated in FIG. 4F, the gaming system evaluated the remaining generated symbols 420*a*-420*o* in the symbol display areas 410*a*-410*o* for additional Placeholder symbols. In FIG. 4F, the gaming system determined that the remaining generated symbols 420*a*-420*o* include an additional placeholder symbol 420*i* in symbol display area 410*i*.

In one embodiment, upon the gaming system having determined that the remaining generated symbols 420*a*-420*o* in the symbol display areas 410*a*-410*o* include a Placeholder symbol 420*i* in symbol display area 410*i*, the gaming system randomly determines one of the pull down symbols from the set of pull down symbols 434*a*-434*c* displayed on the second display device 430 for association with the placeholder symbol 420*i*. As noted above, the pull down symbols 434*a*-434*c* can be weighted the same or differently for purposes of randomly determining one of such pull down symbols 434*a*-434*c*. In some embodiments, the pull down symbols 434*a*-434*c* are weighted differently from the weighting used to generate the replacement Apple symbol 424*k* in symbol display area 410*k*.

In one embodiment, the gaming system randomly determined the pull down Wild symbol 434*a* as a replacement symbol. Upon randomly determining the pull down Wild symbol 434*a*, the processor of the gaming system updates an association of the Placeholder symbol 420*i* with the Wild symbol 434*a*. The Wild symbol 434*a* is used as the symbol in symbol display area 410*i* when determining the winning symbol combinations during the play of the game. In some embodiments, the gaming system highlights the randomly determined pull down symbol to identify to the player that a particular pull down symbol was determined to replace a placeholder symbol.

Figure 4G:
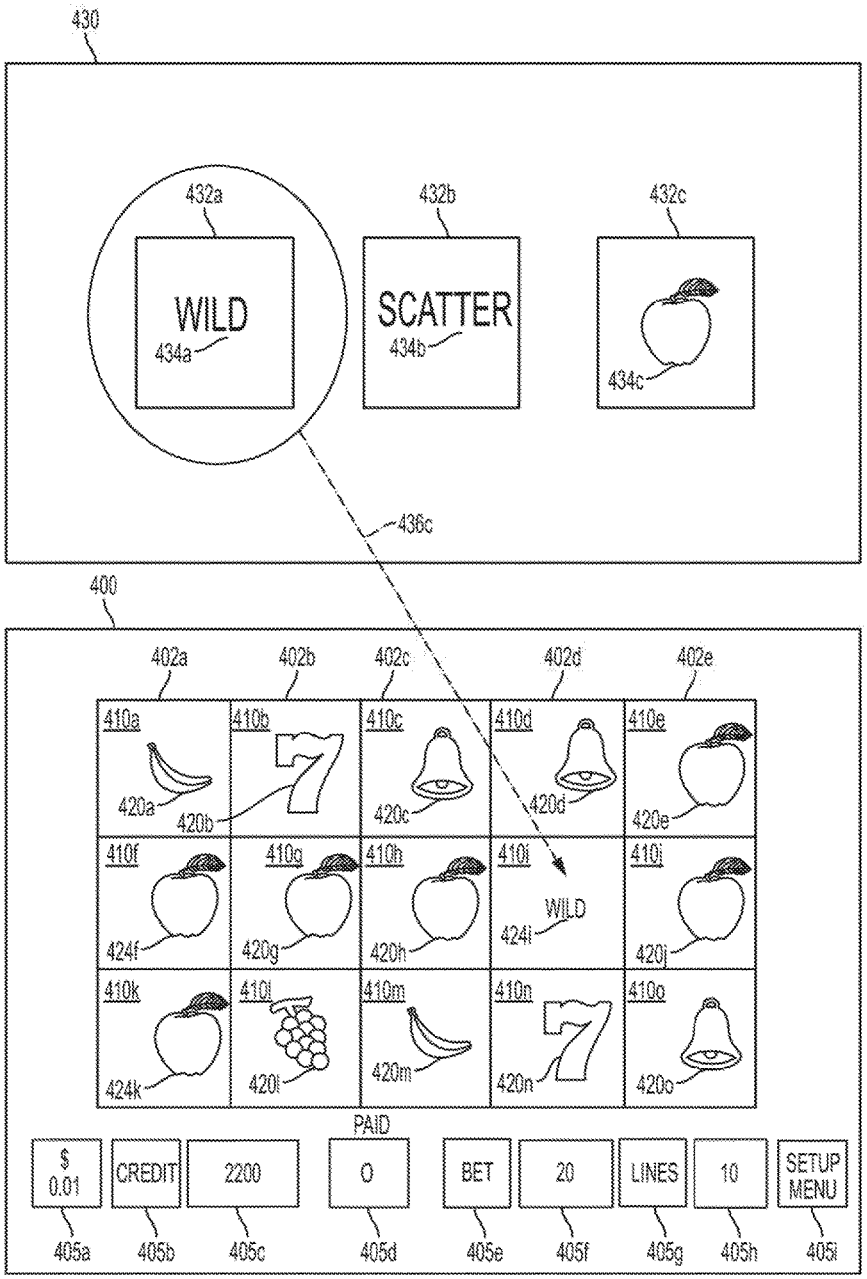

As illustrated in FIG. 4G, the gaming system displays the Wild symbol 424*i* in the symbol display area 410*i*. In one embodiment, when the gaming system displays Wild symbol 424*i* in the symbol display area 410*i* to replace the Placeholder symbol 420*i*, the Wild symbol 424*i* may have identical appearance and size to Wild symbol 434*a*. In alternative embodiments, the Wild symbol 424*i* may have a different appearance and/or size than Wild symbol 434*a*, but is still recognizable to the player as the same pull down symbol. In one embodiment, the request to display the Wild symbol 424*i* in the symbol display area 410*i* may be received from a player via a player input device in communication with the gaming system. For example, the player may press a spin button or a move button on the gaming system to cause the Wild symbol 434*a* to be moved from the symbol display area 432*a* to the symbol display area 424*i*. Waiting for an input from an input device to display the Wild symbol 424*i* in the symbol display area 410*i* increases player involvement in the game. In an alternative embodiment, the processor of the gaming system may automatically display the Wild symbol 424*i* in the symbol display area 410*i*. Any suitable animation may be used to illustrate the movement of the Wild symbol 434*a* to the symbol display area 410*i*.

In one embodiment, the gaming system displays a graphic animation pulling or moving the Wild symbol 434*a*, along phantom line 436*c* as illustrated in FIG. 4G, from pull down symbol display area 432*a* in the second display device 430 to the symbol display area 410*i* in the display device 400. In some embodiments, the graphic animation begins automatically. In some embodiments, the graphic animation begins after the gaming system received an input from an input device in order to increase player involvement.

In one embodiment illustrated in FIG. 4G, the gaming system evaluated the remaining generated symbols 420*a*-420*o* in the symbol display areas 410*a*-410*o* for additional Placeholder symbols. In FIG. 4G, the gaming system determined that the remaining generated symbols 420*a*-420*o* did not include any additional placeholder symbol.

Figure 4H:
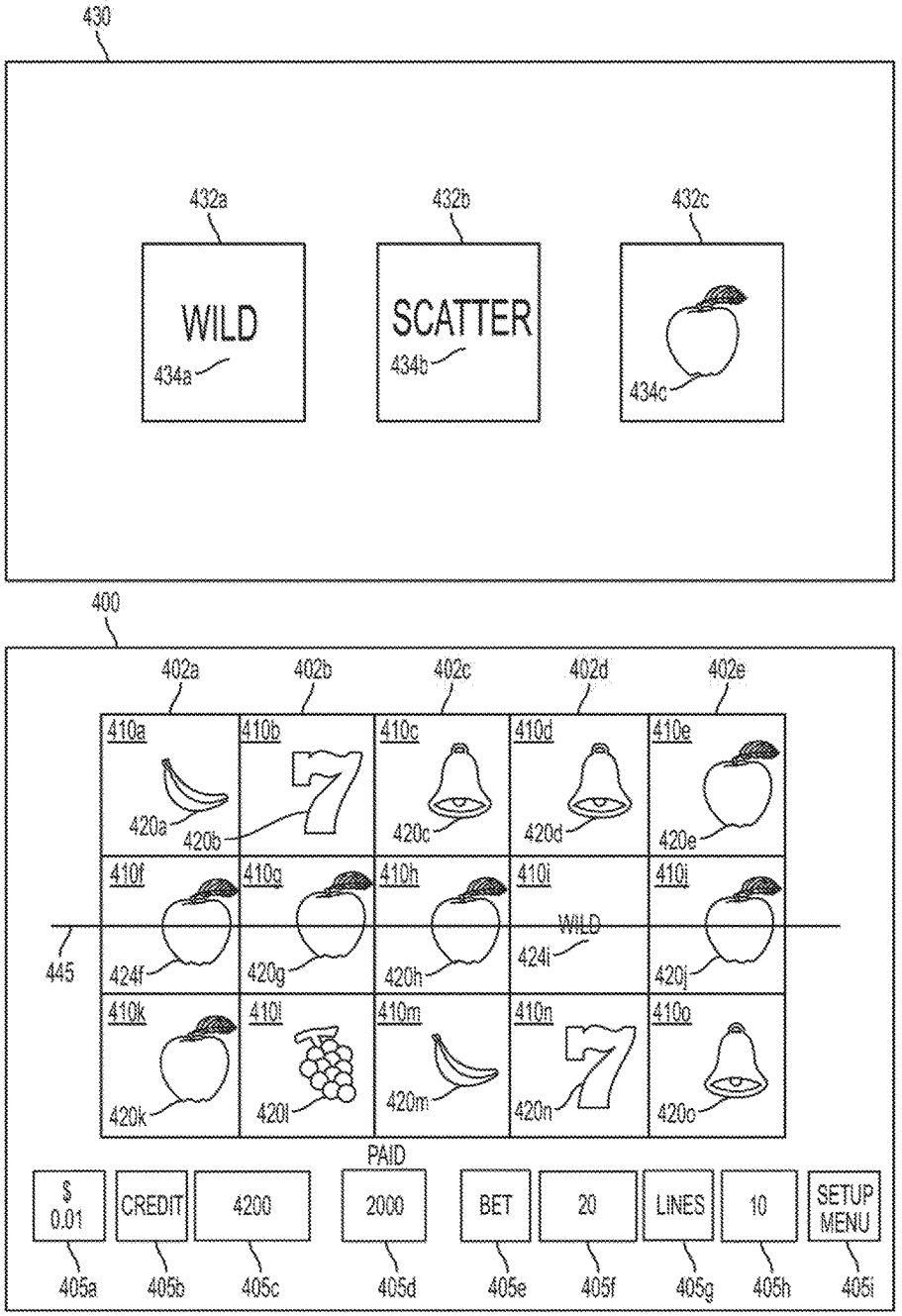

In one embodiment illustrated in FIG. 4H, the gaming system evaluated the generated symbol combinations for winning symbol combinations. In FIG. 4H, the gaming system determined that a winning symbol combination is displayed across one wagered pay line 445. The pay line 445 spans across a horizontal direction of symbol display areas including symbol display areas 410*f*, 410*g*, 410*h*, 410*i*, and 410*j*. In this embodiment, the gaming system displayed four Apple symbols and a Wild symbol along a horizontal active pay line. In some embodiments, active pay lines in the bonus game are independent of any wager in the base game. In some embodiments, one or more pay lines are activated in the bonus game without requiring a wager. In some embodiments, all pay lines are activated in the bonus game without requiring a wager to activate the pay lines. The gaming system determined five Apple symbols form a winning symbol combination based on a pay table associated with the bonus game. In one embodiment, the Wild symbol 424*i* can be treated as having the characteristics any other displayed symbol. In the embodiment illustrated in FIG. 4H, the Wild symbol 424*i* is treated as an Apple symbol for purposes of determining a winning symbol combination. The pay table for the bonus game may include at least some of the payouts in the pay table of the base game, or may include payouts completely different from the pay table of the base game. In this embodiment, the payout for five Apple symbols is 2000 credits. The winning pay line for the bonus game is illustrated as pay line 445 in FIG. 4H across the row of reels 402*f*-402*j*.

As illustrated in FIG. 4H, the gaming system awards the appropriate number of credits to the player and updates the player's win meter (shown in information area 405*d*) to reflect the player's winnings during the play of the game. In one embodiment, the gaming system may also update the player's credit meter (information area 405*c*) to reflect the player's available credit balance. As noted above, while the game as described and illustrated in FIGS. 4D-H is a bonus game, it should be appreciated that the game illustrated in FIGS. 4D-H may be integrated as part of a base game without entering a separate bonus game.

The player may place another wager and start a new play of the game as noted above. However, continued game play is dependent of the number of credits remaining in the player's credit balance. The player may also choose to cash out. In such an instance, the gaming system provides the player a value based on the player's credit balance using any of the value items discussed above (bills, coins, vouchers, etc.).

Figure 5A:
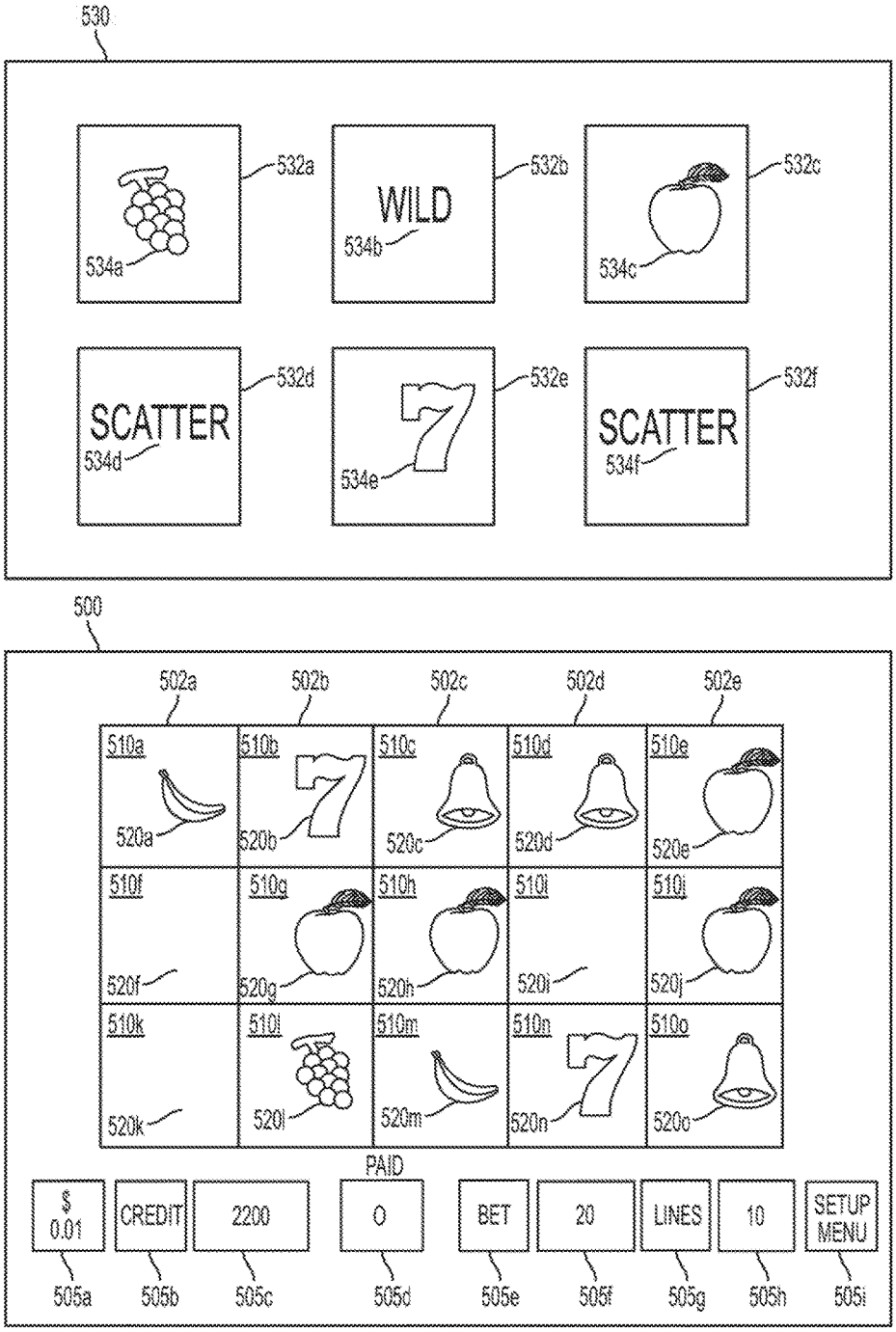
FIGS. 5A, 5B, and 5C illustrate another embodiment of a gaming system including placeholder symbols and pull down symbols.
Figure 5B:
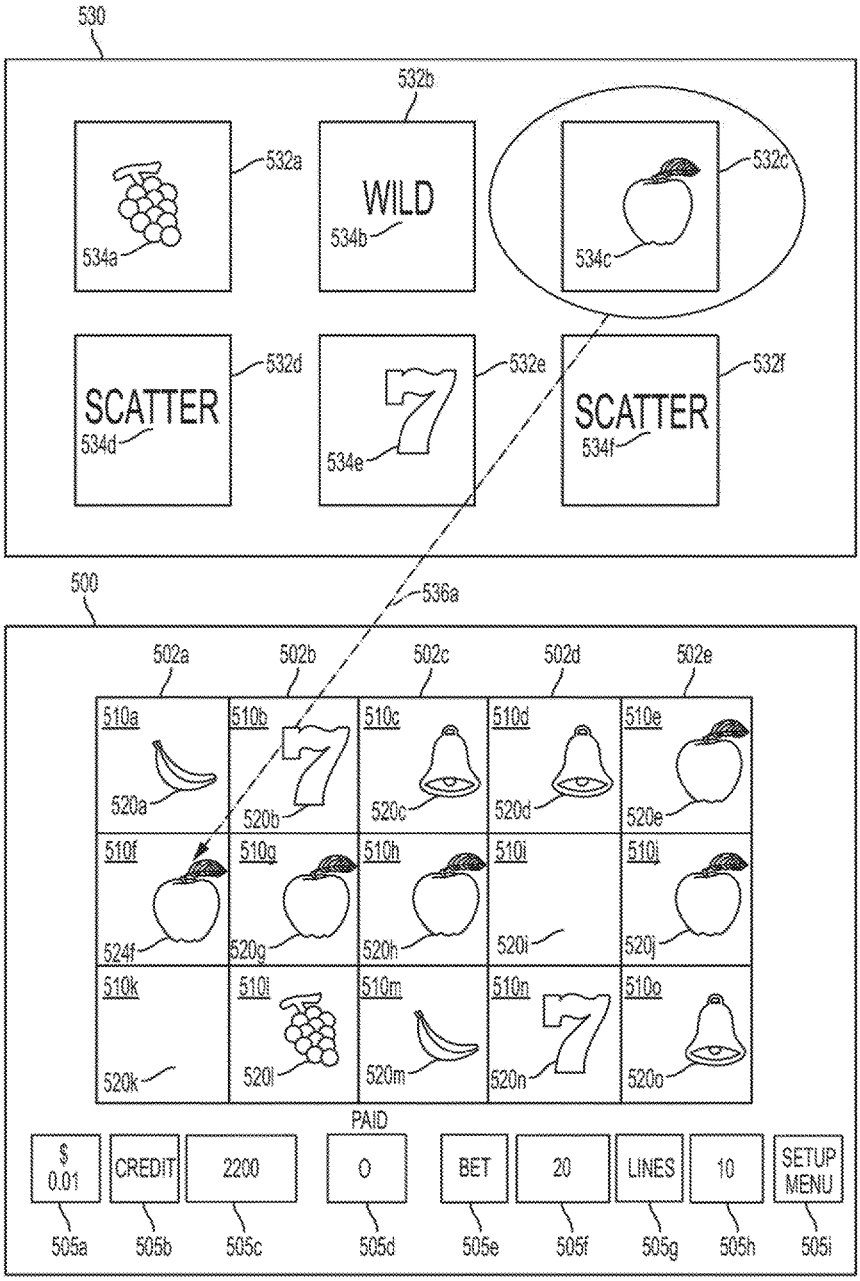
Figure 5C:
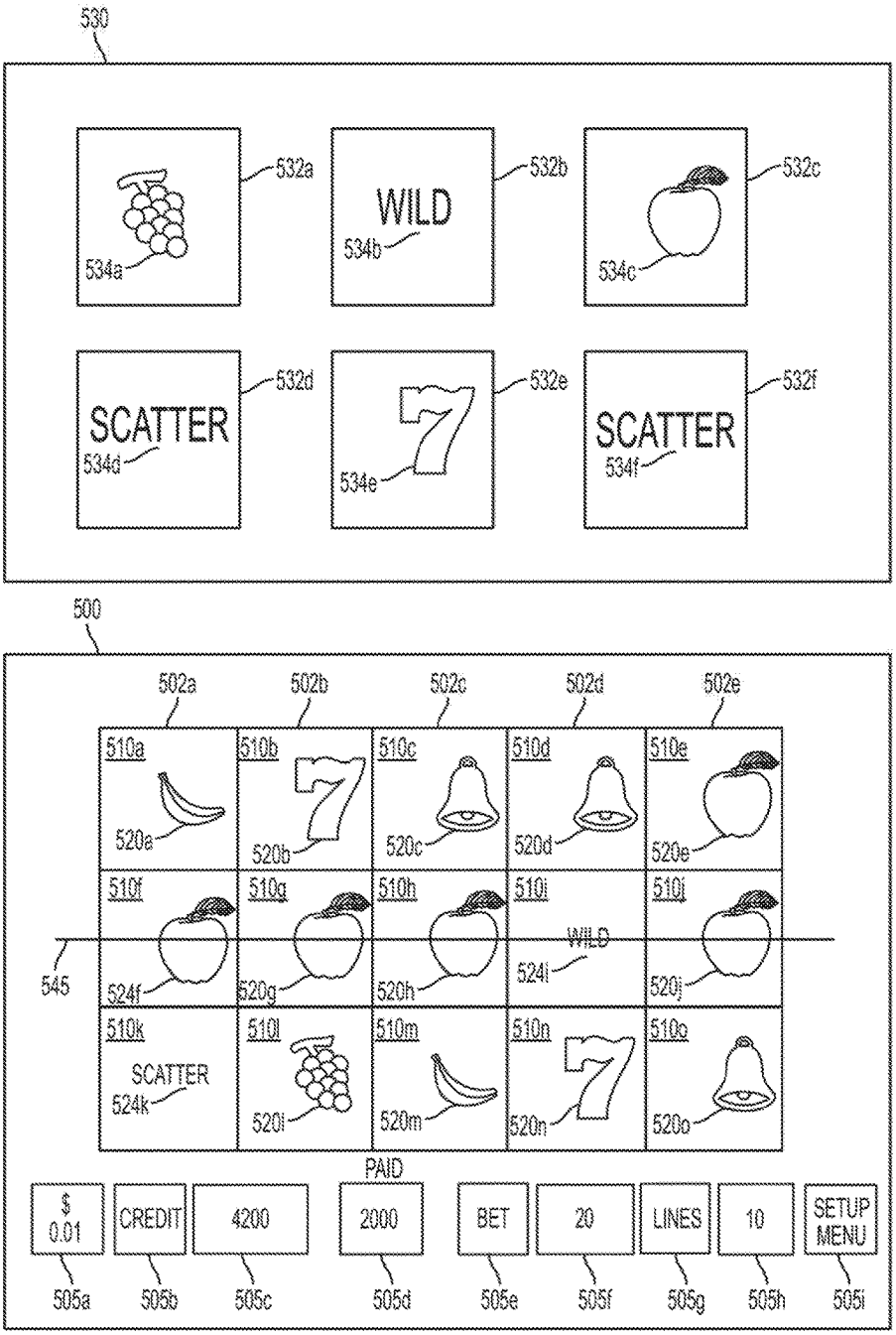

FIGS. 5A-C illustrate screen shots of one embodiment of a gaming system having placeholder symbols and pull down symbols, wherein all the displayed pull down symbols are randomly generated and equal weight is applied to the pull down symbols to randomly determine the pull down symbols to associate with a generated placeholder symbol. It should be appreciated that some of the pull down symbols can be predetermined and that at least one of the pull down symbols can be weighted more heavily than the other pull down symbols for the purpose of determining and association with a generated placeholder symbol.

For the sake of brevity, the base game leading to the bonus game as described and illustrated in FIGS. 5A-C may operate similar to the base game as described and illustrated in FIGS. 4A-C. In the alternative embodiments, the base game can be a different game. As also noted above, while the game as described and illustrated in FIGS. 5A-C is a bonus game, it should be appreciated that the game as described and illustrated in FIGS. 5A-C may be integrated as part of a base game without entering a separate bonus game.

Turning to FIG. 5A, the gaming system uses a random number generator to randomly generate a plurality of symbols 520*a*-520*o* from one or more bonus symbol sets as noted above in connection with FIG. 4D. The bonus symbol sets comprise one or more placeholder symbols. The gaming system displays the generated symbols 520*a*-520*o* from the bonus symbol sets in symbol display areas 510*a*-510*o* of the display device 500 as illustrated in FIG. 5A. Symbols 520*a*-520*o* displayed on reels 502*a*-502*e* illustrate the randomly generated symbols from the bonus symbol sets after the reels have stopped spinning. As illustrated in FIG. 5A, the gaming system randomly generated and displayed symbols 520*a*, 520*f*, and 520*k* in symbol display areas 510*a*, 510*f*, and 510*k* for reel 502*a*. The gaming system also randomly generated and displayed symbols 520*b*, 520*g*, and 520*l* in symbol display areas 510*b*, 510*g*, and 510*l* for reel 502*b*; symbols 520*c*, 520*h*, and 520*m* in symbol display areas 510*c*, 510*h*, and 510*m* for reel 502*c*; symbols 520*d*, 520*i*, and 520*n* in symbol display area 510*d*, 510*i*, and 510*n* for reel 502*d*; symbols 520*e*, 520*j*, and 520*o* in symbol display area 510*e*, 510*j*, and 510*o* for reel 502*e*.

As illustrated in FIG. 5A, the gaming system generated and displayed Banana symbols (520*a*, 520*m*), Seven symbols (520*b*, 520*n*), Apple symbols (520*e*, 520*g*, 520*h*, 520*j*), a Grape symbol (520*l*), Bell symbols (520*c*, 520*o*), and Placeholder symbols (522*f*, 522*i*, 522*k*) in the display device 500. It should be appreciated that the displayed symbol combinations are merely for explanatory purposes and the gaming system may randomly generate any suitable combination of symbols based on defined symbol sets associated with the reels 502*a*-502*e*.

In one embodiment, the gaming system randomly generates one or more pull down symbols from one or more pull down symbol sets. The pull down symbol sets may comprise the same symbols from the base game's symbol sets or the pull down symbol sets may comprise one or more symbols that are different from the symbols from the base game's symbol sets. The pull down symbol sets may comprise at least one Wild symbol and at least one Scatter symbol to increase player excitement. The randomly generated pull down symbols are displayed on a second display device 530. In one embodiment, the second display device 530 may be the second display device 130 of gaming device 100 illustrated in FIG. 1.

Returning now to FIG. 5A, the second display device 530 depicts a plurality of pull down symbol display areas 532*a*-532*f*. The gaming system displays the plurality of randomly generated pull down symbols 534*a*-534*f* in the pull down symbol display areas 532*a*-532*f* It should be appreciated that the number of randomly generated pull down symbols displayed on the second display device 530 are merely for explanatory purposes and the gaming system may display any number of randomly generated pull down symbols, along with the corresponding number of pull down display areas in the second display device.

As illustrated in FIG. 5A, the gaming system randomly generated and displayed a Grape symbol (534*a*), a Wild symbol (534*b*), an Apple Symbol (534*c*), Scatter symbols (534*d* and 534*f*) and a 7 symbol (534*e*) in the pull down symbol display areas 532*a*-532*f* It should be appreciated that the displayed symbol combinations are merely for explanatory purposes and the gaming system may generate any suitable combination of symbols based on the pull down symbol sets.

FIG. 5A further illustrates one embodiment of the bonus game of a gaming system executing an evaluation of the generated symbols 520*a*-520*o* for placeholder symbols. In FIG. 5A, the gaming system determined that the generated symbols include a placeholder symbol 520*f* in symbol display area 510*f*.

In one embodiment, upon the gaming system having determined that the generated symbols 520*a*-520*o* in the symbol display areas 510*a*-510*o* include a Placeholder symbol 520*f* in symbol display area 510*f*, the gaming system randomly determines one of the pull down symbols from the set of pull down symbols 534*a*-534*f* displayed on the second display device 530 for association with the placeholder symbol 520*f*. In one embodiment, the displayed pull down symbols 534*a*-534*f* are weighted equally for purposes of randomly determining one of such pull down symbols, such that the chance for determining one of the displayed pull down symbols is the same as determining any one of the other displayed pull down symbols in a random generation of such pull down symbols.

In one embodiment, the gaming system randomly determined the Apple pull down symbol 534*c* as a replacement for the Placeholder symbol 520*f*. Upon randomly determining the pull down symbol, the processor of the gaming system updates an association between Placeholder symbol 520*f* and the Apple symbol 534*c*. The symbol of the associated randomly determined pull down Apple symbol 534*c* is used as the symbol in symbol display area 510*f* when determining the winning symbol combinations across the reels, rather than the Placeholder symbol 520*f*.

As illustrated in FIG. 5B, the gaming system displays the symbol 524*f* in the symbol display area 510*f* In one embodiment, when the gaming system displays Apple symbol 524*f* in the symbol display area 510*f* to replace the Placeholder symbol 520*f*, the Apple symbol 524*f* may have an identical appearance and size to Apple symbol 534*c*. In alternative embodiments, the Apple symbol 524*f* may have a different appearance and/or size than Apple symbol 534*c*, but is still recognizable to the player as the same pull down symbol. In one embodiment, the request to display the Apple symbol 524*f* in the symbol display area 510*f* may be received from a player via a player input device in communication with the gaming system. For example, the player may press a spin button or a move button on the gaming system to cause the Apple symbol 534*c* to be moved from the symbol display area 532*c* to the symbol display area 524*f*. Waiting for an input from an input device to display the Apple symbol 524*f* in the symbol display area 510*f* increases player involvement in the game. In an alternative embodiment, the processor of the gaming system may automatically display the Apple symbol 524*f* in the symbol display area 510*f*. Any suitable animation may be used to illustrate the movement of the Apple symbol 534*c* to the symbol display area 510*f*.

In one embodiment, the gaming system displays a graphic animation pulling or moving the Apple symbol 434*c*, along phantom line 536*a* as illustrated in FIG. 5B, from pull down symbol display area 532*c* in the second display device 530 to the symbol display area 510*f* in the display device 500. The graphic animation highlights to the player, which of the displayed pull down symbol in the second display device has been determined and the placeholder symbol that has been updated by the determined pull down symbol. The graphic animation also provides the player with a dramatic display of moving the determined pull down symbol into the symbol display area of the placeholder symbol. In some embodiments, the graphic animation begins automatically. In some embodiments, the graphic animation begins after the gaming system received an input from an input device in order to increase player involvement.

In one embodiment, as illustrated in FIG. 5B, the gaming system evaluated the remaining generated symbols 520*a*-520*o* in the symbol display areas 510*a*-510*o* for additional placeholder symbols. In FIG. 5B, the gaming system determined that the remaining generated symbols 520*a*-520*o* include an additional Placeholder symbol 520*k* in symbol display area 510*k* that requires a pull down symbol.

For the sake of brevity, illustrations showing the gaming system selecting additional pull down symbols to replace placeholder symbols is not illustrated. The process of selecting additional pull down symbols and replacing placeholder symbols is the substantially the same or similar to the processes discussed above. For example, the gaming system randomly determines a pull down symbol (Scatter symbol 534*d*) to be associated with the Placeholder symbol 520*k*. The gaming system replaces the displayed Placeholder symbol 520*k* with the Scatter symbol 534*d* similar to the methods described above. Likewise, the gaming system determines that one additional Placeholder symbol 520*i* requires an associated pull down symbol. As such, the gaming system determines a replacement pull down symbol (Wild symbol 534*b*) to associate with Placeholder symbol 520*i*, and displays a replacement of symbol 520*i* with Wild symbol 534*b* using methods similar to the methods described above. In one embodiment, as illustrated in FIG. 5C, the gaming system evaluated the remaining generated symbols 520*a*-520*o* in the symbol display areas 510*a*-510*o* for additional placeholder symbols. In FIG. 5C, the gaming system determined that the remaining generated symbols 520*a*-520*o* did not include any additional placeholder symbols.

In one embodiment, as illustrated in FIG. 5C, the gaming system also evaluated the generated symbol combinations for winning symbol combinations. In FIG. 5C, the gaming system determined that a winning symbol combination is displayed across an active pay line 545. The pay line 545 spans across a horizontal direction of symbol display areas including symbol display areas 510*f*, 510*g*, 510*h*, 510*i*, and 510*j*. In this embodiment, the gaming system displayed four Apple symbols and a Wild symbol along a horizontal pay line 545. The replacement Wild symbol 524*i* is treated as an Apple symbol for purposes of evaluating winning symbol combinations. Thus, the gaming system determined five Apple symbols form a winning symbol combination based on a pay table associated with the bonus game. The pay table for the bonus game may include at least some of the payouts or awards in the pay table of the base game, or may include payouts different from the pay table of the base game. In this embodiment, the payout for five Apple symbols is 2000 credits. The winning pay line for the bonus game is illustrated as pay line 545 in FIG. 5C across the row of reels 502*f*-502*j*.

The gaming system awards the appropriate number of credits to the player and updates the player's win meter (shown in information area 505*d*) to reflect the player's winnings during the play of the game. In one embodiment, the gaming system may also update the player's credit meter (information area 505*c*) to reflect the player's available credit balance.

The player may place another wager and start a new play of the game as noted above. However, continued game play is dependent of the number of credits remaining in the player's credit balance. The player may also choose to cash out. In such an instance, the gaming system provides the player a value based on the player's credit balance using any of the value items discussed above (bills, coins, vouchers, etc.).

Figure 6:
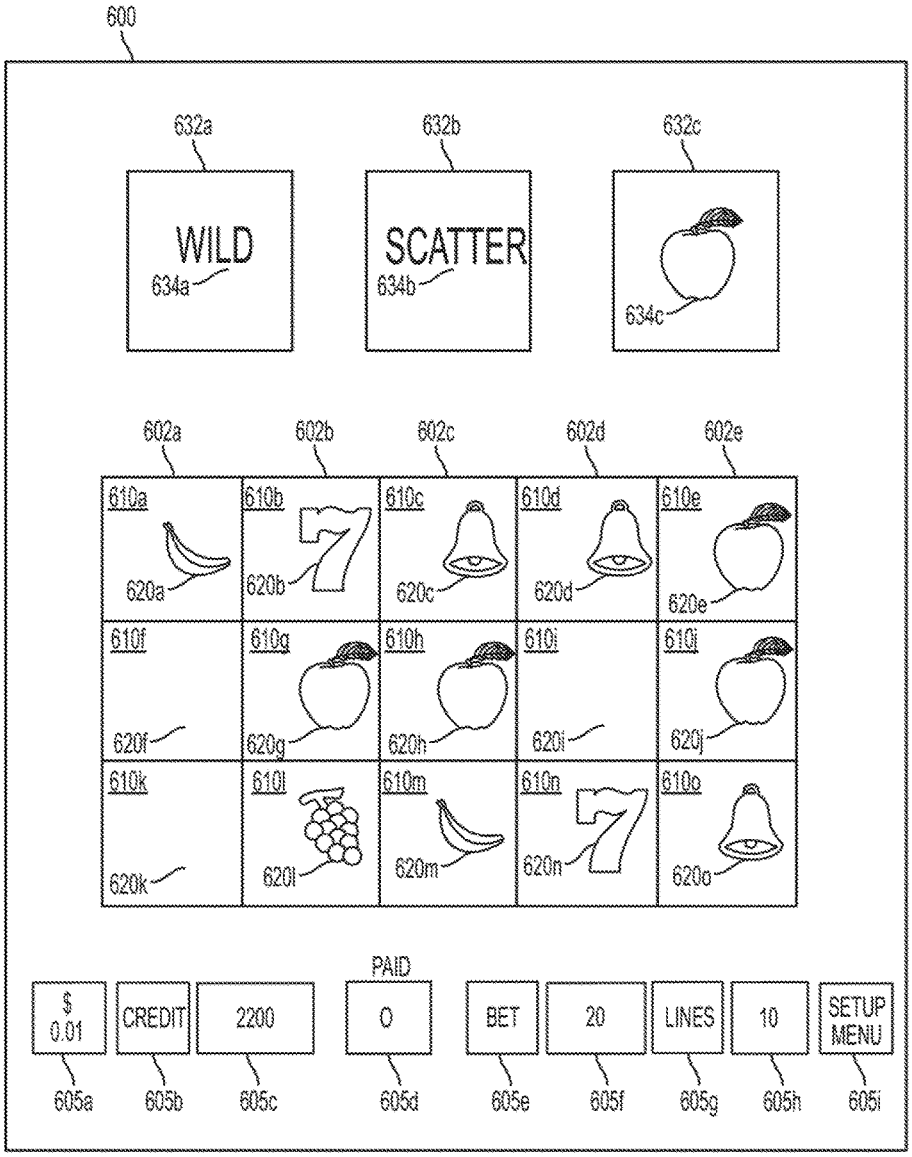
FIG. 6 illustrates a screen shot of one embodiment of a gaming system in which pull down symbols and the reels are displayed on the same display device.

FIG. 6 illustrates a screen shot of one embodiment of a gaming system having pull down symbols and placeholder symbols, where the pull down symbols are displayed on the same display device as other game symbols.

For the sake of brevity, the base game leading to the bonus game as described and illustrated in FIG. 6 may operate similar to the base game as discussed and illustrated in FIGS. 4A-C. In alternative embodiments, the base game can be a different game. As also noted above, while the game as described and illustrated in FIG. 6 is a bonus game, it should be appreciated that the game as described and illustrated in FIG. 6 may be integrated as part of a base game without entering a separate bonus game.

Turning to FIG. 6, the gaming system uses a random number generator to randomly generate a plurality of symbols 620*a*-620*o* from at least one bonus symbol set. The bonus symbol set comprises one or more placeholder symbols. The gaming system displays the generated symbols 620*a*-620*o* from the bonus symbol set in symbol display areas 610*a*-610*o* of the display device 600 as illustrated in FIG. 6. Symbols 620*a*-620*o* displayed on reels 602*a*-602*e* illustrate the randomly generated symbols from the bonus symbol set after the reels have stopped spinning. As illustrated in FIG. 6, the gaming system randomly generated and displayed symbols 620*a*, 620*f*, and 620*k* in symbol display areas 610*a*, 610*f*, and 610*k* for reel 602*a*. The gaming system also randomly generated and displayed symbols 620*b*, 620*g*, and 620*l* in symbol display areas 610*b*, 610*g*, and 610*l* for reel 602*b*; symbols 620*c*, 620*h*, and 620*m* in symbol display areas 610*c*, 610*h*, and 610*m* for reel 602*c*; symbols 620*d*, 620*i*, and 620*n* in symbol display area 610*d*, 610*i*, and 610*n* for reel 602*d*; symbols 620*e*, 620*j*, and 620*o* in symbol display area 610*e*, 610*j*, and 610*o* for reel 602*e*.

As illustrated in FIG. 6, the gaming system generated and displayed Banana symbols (620*a*, 620*m*), Seven symbols (620*b*, 620*n*), Apple symbols (620*e*, 620*g*, 620*h*, 620*j*), a Grape symbol (620*l*), Bell symbols (620*c*, 620*d*, 620*o*), and Placeholder symbols (620*f*, 620*i*, 620*k*) in the display device 600. It should be appreciated that the displayed symbol combinations are merely for explanatory purposes and the gaming system may randomly generate any suitable combination of symbols based on defined symbol sets associated with the reels 602*a*-602*e*.

In one embodiment, the gaming system randomly generates one or more pull down symbols from at least one pull down symbol set. The pull down symbol set may comprise the same symbols from the base game's symbol sets or the pull down symbol set may comprise one or more symbols that are different from the symbols from the base game's symbol sets. The pull down symbol set may comprise at least one wild symbol, at least one scatter symbol, or at least one of both symbols to increase player excitement. The randomly generated pull down symbols are displayed on the display device 600.

Returning now to FIG. 6, the display device 600 depicts a plurality of pull down symbol display areas 632*a*-632*c*. The gaming system displays two predetermined pull down symbols 634*a* and 634*b* and one randomly generated pull down symbol 634*c* in the pull down symbol display areas 632-632*c*. It should be appreciated that number of predetermined pull down symbols and the number of randomly generated pull down symbols displayed on the display device 600 are merely for explanatory purposes and that other quantities of pull down symbols.

As illustrated in FIG. 6, the gaming system displayed Wild symbol 634*a* and Scatter symbol 634*b* as the predetermined pull down symbols and an Apple symbol 634*c* as the randomly generated pull down symbol. It should be appreciated that the displayed symbol combinations are merely for explanatory purposes and the gaming system may include any suitable predetermined pull down symbols and/or generate any suitable combination of symbols based on symbols available in the pull down symbol set.

For the sake of brevity, the game in FIG. 6 may continue to operate similar to the game as discussed and illustrated in FIGS. 4E-4H with the exception that the pull down symbols and the reel are displayed on the same display device 600, rather than on different display devices as was illustrated in some of the previously discussed embodiments.

Based on the forgoing description, it should be appreciated that a gaming system and method with improvements to game outcomes with placeholder symbols and replacement symbols creates new and very exciting ways for a player to obtain improved winnings with a potential to earn frequent and greater awards or to turn a losing gaming into a winning game. Such a potential to earn greater awards creates a greatly improved sense of anticipation for players.

A number of embodiments of the invention have been described. Various modifications may be made without departing from the spirit and scope of the invention. For example, various forms of the flows shown above may be used, with steps re-ordered, added, or removed. Accordingly, other embodiments are within the scope of the following claims.

I claim:

1. A gaming system comprising:

a cabinet;

a processor;

at least one display device supported by the cabinet;

an input device supported by the cabinet;

a value acceptor supported by the cabinet;

a value dispenser supported by the cabinet;

a memory device that stores a plurality of instructions which, when executed by the processor, cause the processor to:

establish a credit balance based at least in part on a monetary value received by the value acceptor;

place a wager following receipt of a wager input via an input device, the credit balance being decreased by the wager;

display a plurality of randomly generated symbols from a first set of symbols, the first set of symbols includes a placeholder symbol, where each symbol is displayed in a symbol display area;

display a plurality of pull down symbols from a second set of symbols, at least one of the plurality of pull down symbols being randomly generated from the second set of symbols;

determine if the placeholder symbol was randomly generated from the first set of symbols;

randomly determine, in response to determining that the placeholder symbol was randomly generated from the first set of symbols, one of the plurality of pull down symbols to associate with the placeholder symbol;

display, in the symbol display area of the associated placeholder symbol, the associated one of the plurality of pull down symbols;

display, on the display device, any determined awards and the credit balance being increased by the any determined awards based on the plurality of randomly generated symbols from the first set of symbols and the associated one of the plurality of pull down symbols; and issue value from the value dispenser based on the credit balance upon receipt of a cash out signal.

2. The gaming system of claim 1, wherein the first set of symbols including a placeholder symbol are in a bonus game.

3. The gaming system of claim 1, wherein the first set of symbols including a placeholder symbol are in a base game.

4. The gaming system of claim 1, wherein at least one predetermined pull down symbol is displayed with the at least one randomly generated pull down symbol.

5. The gaming system of claim 1, wherein symbols in the second set of symbols are weighted equally when randomly generating pull down symbols from the second set of symbols.

6. The gaming system of claim 1, wherein at least one of the symbols in the second set of symbols is weighted differently from at least one other symbol in the second set of symbols when randomly generating pull down symbols from the second set of symbols.

7. The gaming system of claim 1, further comprising a first display device and a second display device, wherein the plurality of randomly generated symbols from a first set of symbols are displayed on the first display device and the plurality of pull down symbols are displayed on the second display device.

8. The gaming system of claim 7, wherein the processor further displays a movement of the associated one of the plurality of pull down symbols moving from the second display device to the first display device before displaying the associated one of the plurality of pull down symbols in the symbol display area of the associated placeholder symbol.

9. The gaming system of claim 8, wherein the movement of the associated one of the plurality of pull down symbols moving from the second display device to the first display occurs after receiving an input from the input device.

10. The gaming system of claim 1, wherein the display of the associated one of the plurality of pull down symbols in symbol display area of the associated placeholder symbol occurs after receiving an input from the input device.

11. The gaming system of claim 1, wherein each of the plurality of pull down symbols is generated from one of a plurality of different symbol sets, wherein each of the plurality of different symbol sets comprises a same plurality of symbols, but at least one of the plurality of different symbol sets comprises symbols that are weighted differently from symbols of at least one other of the plurality of different symbol sets.

12. The gaming system of claim 1, wherein the displayed plurality of pull down symbols includes at least one predetermined pull down symbol.

13. The gaming system of claim 1, wherein each pull down symbol of the displayed plurality of pull down symbols is randomly generated from the second set of symbols.

14. The gaming system of claim 1, wherein the first set of symbols and the second set of symbols comprise the same of symbols.

15. The gaming system of claim 1, wherein the first set of symbols comprises at least one symbol not in the second set of symbols.

16. The gaming system of claim 15, wherein the first set of symbols has greater quantity of symbols than a quantity of symbols in the second set of symbols.

17. The gaming system of claim 1, wherein the first set of symbols comprises at least one wild symbol and at least one scatter symbol.

18. The gaming system of claim 1, wherein the symbol display areas are associated with a plurality of video based slot machine reels.

19. A method of operating a gaming system, the method comprising:

receiving, by a monetary value acceptor, a monetary value;

establishing, by a processor of the gaming system, a credit balance based at least in part on the received monetary value;

accepting, from an input device in a housing of the gaming system, a wager amount;

decreasing, by the processor, the credit balance by the wager amount;

displaying a plurality of randomly generated symbols from a first set of symbols, the first set of symbols includes a placeholder symbol, where each symbol is displayed in a symbol display area;

displaying a plurality of pull down symbols from a second set of symbols, at least one of the plurality of pull down symbols being randomly generated from the second set of symbols;

determining if the placeholder symbol was randomly generated from the first set of symbols;

randomly determining, in response to determining that the placeholder symbol was randomly generated from the first set of symbols, one of the plurality of pull down symbols to associate with the placeholder symbol;

displaying, in the symbol display area of the associated placeholder symbol, the associated one of the plurality of pull down symbols;

displaying any determined awards based on the plurality of randomly generated symbols from the first set of symbols and the associated one of the plurality of pull down symbols;

increasing, by the processor, the credit balance by the any determined awards; and issuing value, by the value dispenser, based on the credit balance upon receipt of a cash out signal.

20. A non-transitory computer-readable storage medium having machine instructions stored therein, the instructions being executable by a processor to cause the processor to:

establish a credit balance based at least in part on a monetary value received by a value acceptor of a gaming device;

place a wager following receipt of a wager input via an input device, the credit balance being decreased by the wager;

display a plurality of randomly generated symbols from a first set of symbols, the first set of symbols comprising a plurality of symbols and a plurality of placeholder symbols, where each randomly generated symbol from the first set of symbols is displayed in a symbol display area;

display a plurality of replacement symbols from a second set of symbols, at least one of the plurality of replacement symbols being randomly generated from the second set of symbols;

determine if a placeholder symbol was randomly generated from the first set of symbols;

randomly determine one of the plurality of replacement symbols to associate with the randomly generated placeholder symbol;

display, in the symbol display area of the randomly generated placeholder symbol, the associated one of the plurality of replacement symbol;

display, on the display device, any determined awards and the credit balance being increased by the any determined awards based on the plurality of randomly generated symbols from the first set of symbols and the associated replacement symbol; and issue value from the value dispenser based on the credit balance upon receipt of a cash out signal.

* * * * *